US012788142B2

(12) United States Patent
Hanlon

(10) Patent No.: US 12,788,142 B2
(45) **Date of Patent: *Nov. 10, 2026**

(54) END SUPPORTS FOR A UTILITY RACK

(71) Applicant: Perfect Site LLC, Las Vegas, NV (US)

(72) Inventor: Jared W. Hanlon, Las Vegas, NV (US)

(73) Assignee: Perfect Site LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/948,093

(22) Filed: Nov. 14, 2024

(65) Prior Publication Data

US 2025/0064207 A1 Feb. 27, 2025

Related U.S. Application Data

(63) Continuation of application No. 18/197,264, filed on May 15, 2023, now Pat. No. 12,144,421, which is a
(Continued)

(51) Int. Cl.
*A47B 57/50* (2006.01)
*A47B 47/00* (2006.01)
(Continued)

(52) U.S. Cl.
CPC ..... *A47B 57/50* (2013.01); *A47B 47/0083* (2013.01); *A47B 47/028* (2013.01);
(Continued)

(58) Field of Classification Search
CPC ... A47B 57/50; A47B 47/0083; A47B 47/028; A47B 57/40; A47B 46/00; A47B 47/02;
(Continued)

(56) References Cited

U.S. PATENT DOCUMENTS 1,748,546 A 2/1930 Dunmire
1,951,888 A * 3/1934 Tinsley ..... E02F 9/2825 108/160

(Continued)

FOREIGN PATENT DOCUMENTS

CN 201064290 5/2008
CN 202381473 8/2012

(Continued)

OTHER PUBLICATIONS

PCT Search Report and Written Opinion for PCT/US2021/050531; 11 Pages; mailed Dec. 7, 2021.

*Primary Examiner* — Devin K Barnett
(74) *Attorney, Agent, or Firm* — Snell & Wilmer LLP

(57) ABSTRACT

Disclosed is a utility rack system that includes shelves having a first end, a second end, and a pair of end supports. Each of the pair of end supports is configured to support either the first end or the second end of the one or more elongated shelves. Each of the pair of end supports includes a first vertical member and a second vertical member, and upper and lower cross members and a diagonal support pivotally coupled at one end to one of the vertical member and selectively lockable, such as via a sliding lock mechanism, to the other vertical member.

20 Claims, 19 Drawing Sheets

Related U.S. Application Data continuation of application No. 17/476,337, filed on Sep. 15, 2021, now Pat. No. 11,647,833.

(60) Provisional application No. 63/079,443, filed on Sep. 16, 2020.

(51) Int. Cl.

| | |
|---|---|
| ***A47B 47/02*** | (2006.01) |
| *A47B 46/00* | (2006.01) |
| *A47B 57/40* | (2006.01) |
| *A47B 96/14* | (2006.01) |
| *A47F 5/10* | (2006.01) |

(52) U.S. Cl.

CPC ..... *A47B 46/00* (2013.01); *A47B 47/00* (2013.01); *A47B 57/40* (2013.01); *A47B 96/14* (2013.01); *A47B 96/1441* (2013.01); *A47F 5/10* (2013.01)

(58) Field of Classification Search

CPC . A47B 96/14; A47B 96/1441; A47B 96/1475; A47B 43/00; A47B 47/00; A47B 47/021; A47B 47/027; A47F 5/10

See application file for complete search history.

(56) References Cited

U.S. PATENT DOCUMENTS 2,246,457 A 6/1941 Schultz
2,280,084 A 4/1942 Segal
2,374,550 A 4/1945 McIntosh
2,604,213 A * 7/1952 Bales ..... A47B 57/482 52/762
2,833,333 A * 5/1958 Babineau ..... E04G 3/24 182/187
2,918,176 A * 12/1959 Bell ..... A47B 47/027 211/187
2,932,368 A 4/1960 Schell, Jr.
3,042,221 A * 7/1962 Rasmussen ..... A47B 57/50 211/183
3,056,507 A 10/1962 Squires, Jr. et al.
3,070,237 A * 12/1962 Fullerton ..... A47B 57/50 211/187
3,072,262 A 1/1963 Cassel
3,193,060 A 7/1965 Park
3,194,407 A 7/1965 D'Altrui
3,221,894 A * 12/1965 Knuth ..... A47B 57/30 211/187
3,235,038 A * 2/1966 Nesslinger ..... E04G 1/34 52/645
3,285,428 A 11/1966 Scheck
3,305,255 A 2/1967 Henderson
3,475,044 A * 10/1969 Konstant ..... E04G 7/26 403/217
3,625,372 A * 12/1971 MacKenzie ..... A47B 57/402 211/191
3,647,080 A 3/1972 Denny
3,741,405 A * 6/1973 McConnell ..... A47B 57/487 211/192
3,858,996 A 1/1975 Jarvis
3,862,691 A 1/1975 Mori et al.
3,900,111 A 8/1975 Hiler et al.
3,986,462 A * 10/1976 Heft ..... A47B 96/02 211/188
4,030,612 A * 6/1977 Gray ..... F16B 12/32 403/321
4,078,664 A * 3/1978 McConnell ..... A47B 96/00 211/187
4,088,229 A * 5/1978 Jacoby ..... A47B 91/00 211/183
4,101,233 A 7/1978 McConnell
4,165,698 A 8/1979 Ferdinand
4,179,143 A * 12/1979 Shy ..... E05C 1/04 292/179
4,197,952 A 4/1980 De Fouw et al.
4,199,069 A 4/1980 Talarico
4,236,642 A 12/1980 Klein
4,262,809 A * 4/1981 McConnell ..... A47B 57/50 403/317
4,351,244 A 9/1982 Suttles
4,423,817 A 1/1984 Monjo-Rufi
4,545,490 A 10/1985 Hsiao et al.
4,549,665 A 10/1985 Smitley
4,632,222 A 12/1986 Chen
4,645,276 A 2/1987 Flavigny
4,648,517 A * 3/1987 Schafer ..... F16B 7/22 108/162
4,665,838 A 5/1987 Minshall
4,742,782 A 5/1988 Miller
4,773,547 A 9/1988 Bell
4,796,541 A 1/1989 Halstrick
4,996,929 A 3/1991 Saal
5,012,938 A * 5/1991 King ..... A47B 57/18 211/182
5,190,171 A 3/1993 Christman, Jr.
5,190,172 A 3/1993 Tyson
5,194,407 A 3/1993 Waisala et al.
5,263,296 A 11/1993 Spera
5,297,486 A 3/1994 Herrmann
5,463,966 A 11/1995 Nilsson
5,713,651 A 2/1998 Essig et al.
5,791,502 A 8/1998 Bietz
5,823,292 A 10/1998 Krause
5,845,795 A 12/1998 Mulholland
5,938,367 A * 8/1999 Olson ..... E04B 1/58 211/192
6,155,441 A 12/2000 Andersen
6,223,494 B1 5/2001 Bright
6,241,109 B1 6/2001 Kautz
6,332,548 B1 12/2001 West
6,510,955 B2 * 1/2003 Pellegrino ..... F16B 7/0446 211/192
6,527,473 B2 3/2003 Chen
6,604,640 B1 8/2003 Jehin
6,776,298 B2 8/2004 Courtwright
6,902,074 B2 6/2005 Albrecht
6,920,831 B2 7/2005 Lin
7,044,312 B2 5/2006 Yang
7,128,225 B2 10/2006 Saltzburg et al.
7,252,202 B2 8/2007 Saltzburg et al.
7,365,268 B2 4/2008 Collins et al.
D569,143 S 5/2008 Liss et al.
D571,133 S 6/2008 Liss et al.
D571,589 S 6/2008 Liss et al.
D572,053 S 7/2008 Liss et al.
D572,054 S 7/2008 Liss et al.
D585,680 S 2/2009 Liss et al.
D585,681 S 2/2009 Liss et al.
D585,682 S 2/2009 Liss et al.
D587,046 S 2/2009 Liss et al.
D597,353 S 8/2009 Liss et al.
D597,354 S 8/2009 Liss
D604,065 S 11/2009 Towater et al.
D604,537 S 11/2009 Liss et al.
D604,538 S 11/2009 Liss et al.
7,748,546 B2 7/2010 Konstant
7,753,220 B2 7/2010 Konstant
7,810,770 B2 10/2010 Treadwell
8,172,098 B2 5/2012 Eustace et al.
8,292,093 B2 10/2012 Fan
8,292,380 B2 10/2012 Fan
8,302,788 B2 * 11/2012 Vargo ..... A47B 57/50 211/186
8,365,479 B2 2/2013 Tucker
8,403,157 B2 3/2013 Kleinsasser
8,443,992 B2 5/2013 Lawson et al.
D683,983 S * 6/2013 Troyner ..... D6/675.2
8,585,313 B2 11/2013 Wojotowicz et al.
8,632,272 B2 1/2014 Wojotowicz et al.
8,672,577 B2 3/2014 Wojotowicz et al.
8,695,816 B2 4/2014 Troyner et al.

(56) References Cited

U.S. PATENT DOCUMENTS

| | | | | |
|---|---|---|---|---|
| 8,714,864 | B2 | 5/2014 | Wojotowicz et al. | |
| D708,051 | S | 7/2014 | Wojotowicz et al. | |
| 8,881,660 | B2 | 11/2014 | Simpson | |
| 8,960,451 | B2 | 2/2015 | Florence, Jr. et al. | |
| 9,027,767 | B2 | 5/2015 | Buckley et al. | |
| 9,033,164 | B2 | 5/2015 | Troyner et al. | |
| 9,093,583 | B2 | 7/2015 | Hamilton | |
| 9,232,858 | B2 | 1/2016 | Scholz | |
| 9,301,610 | B1 | 4/2016 | Berry | |
| 9,375,102 | B2 * | 6/2016 | Troyner | A47F 5/01 |
| 9,386,855 | B2 | 7/2016 | Sabounjian | |
| 9,439,508 | B2 | 9/2016 | Wojotowicz et al. | |
| 9,474,370 | B2 | 10/2016 | Troyner et al. | |
| D777,479 | S | 1/2017 | Anderson | |
| 9,661,921 | B1 | 5/2017 | Tsai | |
| 9,723,925 | B1 | 8/2017 | Tsai | |
| D800,347 | S | 10/2017 | Blick | |
| 9,924,797 | B2 | 3/2018 | Hanlon | |
| 9,993,075 | B2 | 6/2018 | Buckley et al. | |
| 9,999,303 | B2 | 6/2018 | Tan | |
| 10,149,541 | B2 | 12/2018 | Hanlon | |
| 10,238,208 | B2 | 3/2019 | Henonin | |
| 10,299,589 | B1 | 5/2019 | Lai et al. | |
| 10,299,593 | B2 | 5/2019 | Bruckner et al. | |
| 10,299,594 | B2 | 5/2019 | Liss et al. | |
| D857,434 | S | 8/2019 | Liu | |
| 10,389,092 | B2 | 8/2019 | Matsumoto | |
| 10,597,189 | B2 | 3/2020 | Gu et al. | |
| 10,626,905 | B1 | 4/2020 | Chiu | |
| 10,694,849 | B2 | 6/2020 | Liss et al. | |
| 10,702,062 | B2 | 7/2020 | Lee | |
| 10,806,257 | B1 * | 10/2020 | Liu | A47B 47/024 |
| 10,806,258 | B2 | 10/2020 | Hanlon | |
| 10,858,185 | B1 | 12/2020 | Lellimo | |
| 10,925,390 | B2 | 2/2021 | Reuter et al. | |
| 10,974,352 | B1 * | 4/2021 | Klinger | B23P 6/00 |
| D920,722 | S | 6/2021 | Li | |
| 11,026,509 | B2 * | 6/2021 | Walker | A47B 47/0083 |
| 11,028,586 | B2 | 6/2021 | Iellimo | |
| 11,033,106 | B2 | 6/2021 | Murphy | |
| 11,039,686 | B2 | 6/2021 | Min | |
| 11,064,806 | B1 | 7/2021 | Ge | |
| 11,083,289 | B2 | 8/2021 | Nemeth et al. | |
| 11,647,833 | B2 * | 5/2023 | Hanlon | A47B 47/028 211/192 |
| 11,925,258 | B2 | 3/2024 | Chakraborthy | |
| 12,144,421 | B2 * | 11/2024 | Hanlon | A47B 96/021 |
| 2004/0045921 | A1 | 3/2004 | Muller | |
| 2004/0182810 | A1 | 9/2004 | Rosen | |
| 2005/0103736 | A1 | 5/2005 | Calleja | |
| 2006/0144809 | A1 | 7/2006 | Collins et al. | |
| 2006/0163438 | A1 | 7/2006 | Wojotowicz et al. | |
| 2006/0196842 | A1 | 9/2006 | Taylor et al. | |
| 2007/0175846 | A1 | 8/2007 | Konstant | |
| 2008/0145197 | A1 | 6/2008 | Taylor et al. | |
| 2008/0166503 | A1 * | 7/2008 | Fu | A47B 43/00 428/12 |
| 2008/0173603 | A1 * | 7/2008 | Dion | A47F 5/00 211/182 |
| 2008/0265728 | A1 | 10/2008 | Collins et al. | |
| 2008/0272266 | A1 | 11/2008 | Eustace et al. | |
| 2009/0277854 | A1 * | 11/2009 | Eustace | A47B 57/22 211/183 |
| 2011/0042336 | A1 | 2/2011 | Cheng et al. | |
| 2011/0266239 | A1 | 11/2011 | Daily | |
| 2011/0278251 | A1 * | 11/2011 | Smith | A47F 5/01 211/183 |
| 2012/0067838 | A1 * | 3/2012 | Lawson | A47B 47/024 211/183 |
| 2012/0187065 | A1 | 7/2012 | Song | |
| 2012/0193314 | A1 | 8/2012 | Liao | |
| 2013/0098856 | A1 * | 4/2013 | Troyner | A47B 47/0083 211/183 |
| 2014/0116973 | A1 * | 5/2014 | Buckley | A47F 5/00 29/525.01 |
| 2015/0090683 | A1 * | 4/2015 | Sabounjian | A47B 96/14 211/186 |
| 2016/0220018 | A1 * | 8/2016 | Hanlon | A47B 47/021 |
| 2017/0280875 | A1 | 10/2017 | Buckley et al. | |
| 2019/0239639 | A1 | 8/2019 | Brunner | |
| 2020/0054126 | A1 | 2/2020 | Globerman | |
| 2020/0165064 | A1 * | 5/2020 | Harrison | B65G 1/02 |
| 2020/0297113 | A1 | 9/2020 | Liss et al. | |
| 2021/0030149 | A1 | 2/2021 | Carrasco Lopez | |
| 2021/0054638 | A1 * | 2/2021 | Steck | E04G 1/14 |
| 2021/0337964 | A1 | 11/2021 | Williams et al. | |
| 2025/0017365 | A1 * | 1/2025 | Beck | A47B 47/027 |

FOREIGN PATENT DOCUMENTS

| | | |
|---|---|---|
| CN | 109043911 | 12/2018 |
| CN | 105864242 | 1/2019 |
| CN | 209106621 | 7/2019 |
| CN | 209862877 | 12/2019 |
| CN | ZL 201510294195.X | 7/2020 |
| CN | 212678648 | 3/2021 |
| CN | 213075023 | 4/2021 |
| DE | 4314682 | 11/1994 |
| DE | 29808396 | 8/1998 |
| DE | 202006008038 | 10/2006 |
| DE | 202012009433 | 11/2012 |
| EP | 1151695 | 11/2001 |
| EP | 808589 | 7/2003 |
| GB | 570503 | 7/1945 |
| GB | 2148100 | 5/1985 |
| GB | 2368469 | 11/2003 |
| GB | 2486640 | 4/2014 |
| KR | 200320245 | 7/2003 |
| KR | 200473792 | 8/2014 |
| KR | 20210115689 | 9/2021 |
| RU | 2723362 | 6/2020 |
| WO | 20053056 | 9/2000 |
| WO | 2019033287 | 2/2019 |
| WO | 2020062196 | 4/2020 |

* cited by examiner

END SUPPORTS FOR A UTILITY RACK

RELATED APPLICATION DATA

This application is a continuation of U.S. patent application Ser. No. 18/197,264, filed May 15, 2023, which is a continuation of U.S. patent application Ser. No. 17/476,337 filed Sep. 15, 2021, now U.S. Pat. No. 11,647,833, which claims the benefit of U.S. Provisional Application Ser. No. 63/079,443, filed Sep. 16, 2020. The present application claims priority to each of said applications and incorporates by reference each of said applications as if set forth fully herein.

FIELD OF THE INVENTION

The present invention relates to shelving systems and more particularly relates to collapsible utility rack systems.

BACKGROUND OF THE INVENTION

Collapsible utility rack systems are a popular way to add storage in a home, office, garage, warehouse, or other facility. Such systems typically include one or more shelves which are supported by free-standing end supports. The vertically oriented end supports connect to shelf supports. Together, the end supports and the shelf supports provide the rigidity for supporting the shelves and anything placed on the shelves. Typically, end supports are formed of one or more members, which may include diagonal braces. These members are generally formed as a single unitary structure. While strong, unitary structures are large and difficult for packaging and transporting.

To overcome this, utility rack systems are available that come unassembled. Such a system uses end supports which are produced and shipped with the vertical end supports and braces as separate individual members. While reducing space in the packaging, the purchaser must still assemble the shelving system, which requires the use of tools and the tightening of many fasteners. If assembled incorrectly, the shelf system is potentially un-safe for storing heavy objects. Further, while only the end support has been discussed, the shelves themselves also require bulky and unwieldly packaging.

SUMMARY OF THE INVENTION

A system for a utility rack is disclosed. The system includes shelves having a first end, a second end, and a pair of end supports. Each of the pair of end supports is configured to support either the first end or the second end of the one or more elongated shelves. Each of the pair of end supports includes a first vertical member and a second vertical member, and upper and lower cross members and a diagonal support pivotally coupled at one end to one of the vertical member and selectively connectable, such as via a sliding lock mechanism, to the other vertical member.

In certain examples, the sliding lock mechanism is movable along a first axis, with reference to the upper cross member, lower cross member and/or diagonal support, between an unlocked position and a locked position. The sliding lock mechanism also includes a safety lock biased outward substantially perpendicularly with reference to the axis and configured to engage an opening in the diagonal support.

In certain examples, the upper cross member, lower cross member and/or diagonal support includes a base, a pair of sidewalls extending outward from the base to form a channel, and an end tab disposed at an end of the diagonal support. In certain examples, the upper cross member, lower cross member and/or diagonal support includes a cutout formed in the pair of sidewalls configured to engage a locking pin of the first vertical member. The sliding lock mechanism is disposed within the channel and further comprises a knob configured to pass through a slot formed in the base of the cross member or support, and where the knob is configured to maintain the sliding lock mechanism within the channel.

In certain examples, the sliding lock mechanism is configured to, when in the locked position, surround the locking pin such that the sliding lock mechanism captures the locking pin in a slot between upper and lower portion of a body thereof. When the sliding lock mechanism is in the unlocked position, the cross-members and diagonal support may be disconnected from corresponding vertical members, allowing the end support to be collapsed to a configuration in which the cross-members an diagonal support extend parallel to the vertical members and allowing the vertical members to be positioned adjacent to one another.

In certain examples, the one or more elongated shelves are wire shelves, and are formed of two or more shelf portions removably coupled to each other. The utility rack system also includes, in certain examples, a shelf beam configured to couple at a first end to a first one of the pair of end supports and at a second end to a second one of the pair of end supports. The shelf beam comprises a base and a pair of sidewalls extending from the base to form a longitudinal channel. In certain examples, the system includes a shelf cross support that is coupled at a first end to the shelf beam and at a second end to a second shelf beam, and where the shelf cross support is configured to support one of the one or more elongated shelves. The shelf cross support is configured to nest within the shelf beam or the second shelf beam. In certain examples, the shelf cross support further comprises a surface feature configured to increase the rigidity of the shelf cross support. The shelf cross support further comprises a first side flange and a second side flange, and where the first side flange extends outward a distance that is greater than a distance of the second side flange.

Further objects, features, and advantages of the present invention over the prior art will become apparent from the detailed description of the drawings which follows, when considered with the attached figures.

DETAILED DESCRIPTION OF THE INVENTION

Figure 1:
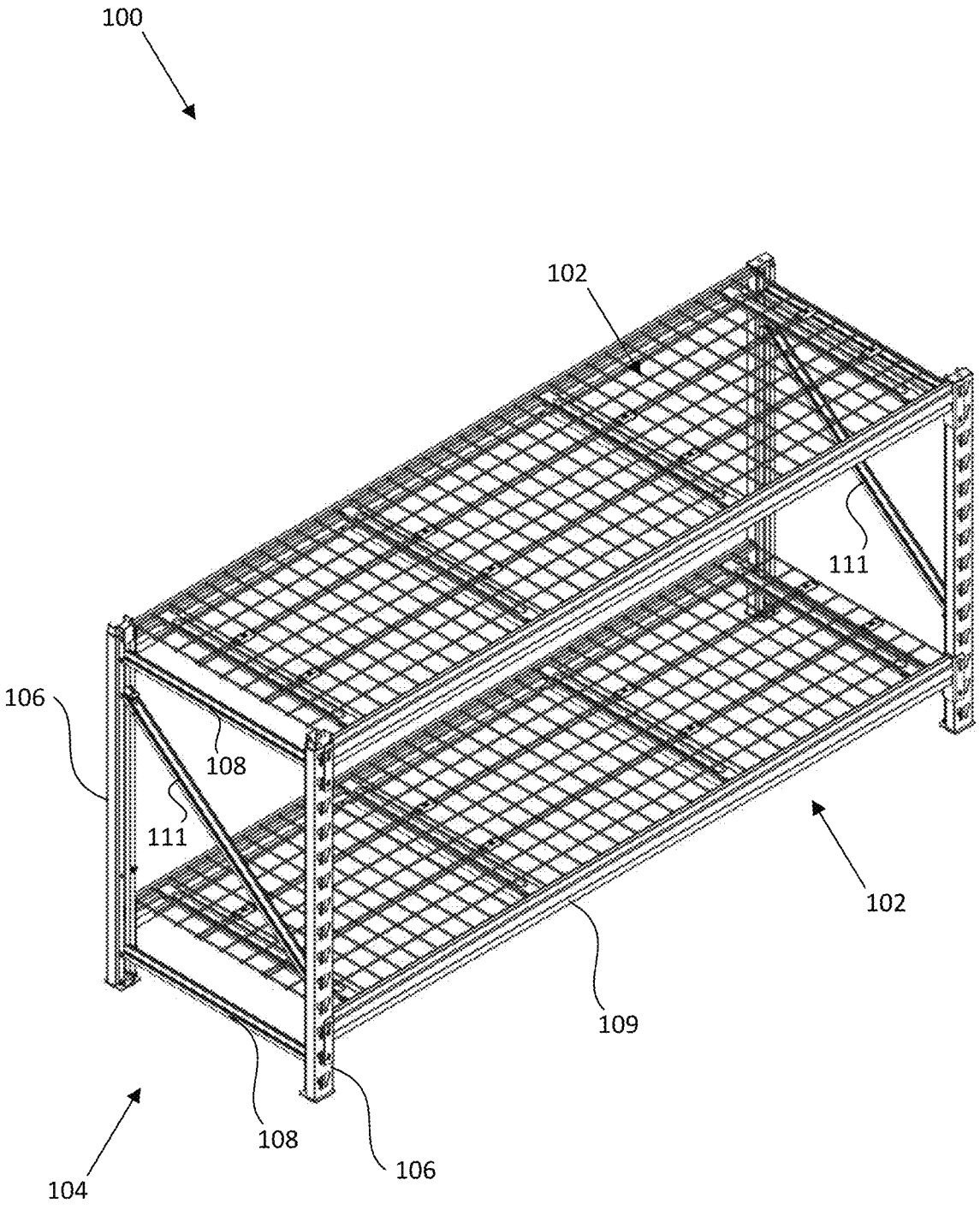
FIG. 1 is a perspective view diagram illustrating one example of a shelving or rack system, according to examples of the subject disclosure.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. The term "and/or" indicates embodiments of one or more of the listed elements, with "A and/or B" indicating embodiments of element A alone, element B alone, or elements A and B taken together.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flowchart diagrams and/or schematic block diagrams in the Figures illustrate the architecture, functionality, and operation of possible implementations. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Although various arrow types and line types may be employed in the flowchart and/or block diagrams, they are understood not to limit the scope of the corresponding embodiments. Indeed, some arrows or other connectors may be used to indicate only an exemplary logical flow of the depicted embodiment.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users.

The description of elements in each figure may refer to elements of proceeding figures. Like numbers refer to like elements in all figures, including alternate embodiments of like elements.

FIG. 1 is a perspective view diagram illustrating one example of a shelving or rack system 100, according to examples of the subject disclosure. The rack system 100 is useful for storing items in a home, office, garage, warehouse, or other facility. The rack system 100, in certain examples, includes a number of elongated shelves 102 which are supported by end supports 104. The end supports 104 include vertical members 106 that are joined by one or more cross members 108 (an upper cross member and a lower cross member) to provide rigidity to the end supports 104, and a diagonal member 111. As will be described in greater detail below, the rack system 100 of the subject disclosure beneficially is collapsible into a compact package for shipping purposes.

The end supports 104 collapse (see FIGS. 10*a*-10*c*) and are nestable inside of a channel formed by a shelf beam 109. The shelves 102 are foldable to reduce an overall footprint. Accordingly, the width of the packaging is sized to accommodate the width of a folded shelf 102. In some examples, the shelves 102 are folded in half, in other examples, the shelves are folded in thirds along lengthwise borders. Additionally, the rack system 100 of the subject disclosure is rapidly assembled using a shuttle lock system that is slidingly disposed within a diagonal member 111 and locks around a pin (see FIGS. 3 and 6) formed in the vertical member 106. Although depicted here as a 2-shelf system, any suitable number of shelves is contemplated.

Figure 2:
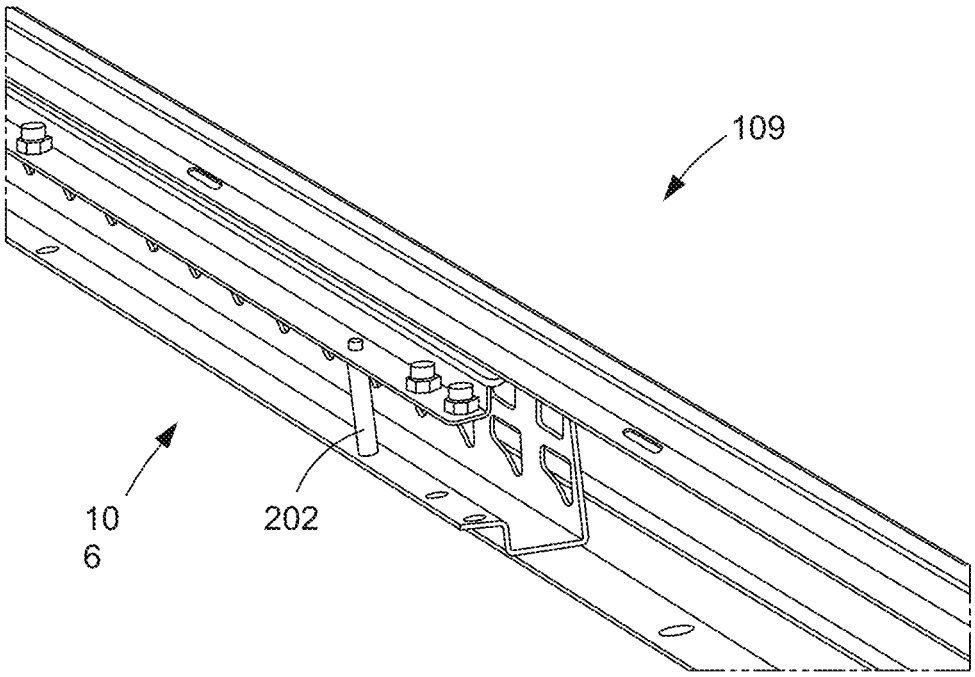
FIG. 2 is a perspective view diagram illustrating one example of a vertical member nested in a shelf beam (or shelf support), according to examples of the subject disclosure.

FIG. 2 is a perspective view diagram illustrating one example of a vertical member 106 nested in a shelf beam (or shelf support) 109, according to examples of the subject disclosure. The vertical member 106 and the shelf support 109 are formed of, in certain examples, stamped steel that has a general "C" shape. Stated differently, each of the vertical member 106 and the shelf support 109 care formed having an open channel. The channel of the shelf support 109 is sized to allow the vertical member 106 to nest within the channel of the shelf support 109. In other words, the opening formed by the "C" shape is sufficient to receive the vertical member 106. This beneficially reduces the space required to package the vertical members 106 and shelf supports 109. Each shelf support 109 may be configured to couple with, at each end, a vertical member 106.

Also depicted in FIG. 2 is the pin 202 as described above with reference to FIG. 1. The pin 202 allows the shuttle lock system to couple the diagonal member 111 with the vertical member 106. This, beneficially, allows for the end support 104 to expand from a collapsed arrangement to a fully extended and locked position without the use of tools. A user only needs to pivot one vertical member 106 away from its opposing vertical member 106, position an end of the diagonal member 111 on the pin 202, and slide the shuttle lock system into place, as will be described in greater detail below with reference to FIGS. 3-6.

Figure 3:
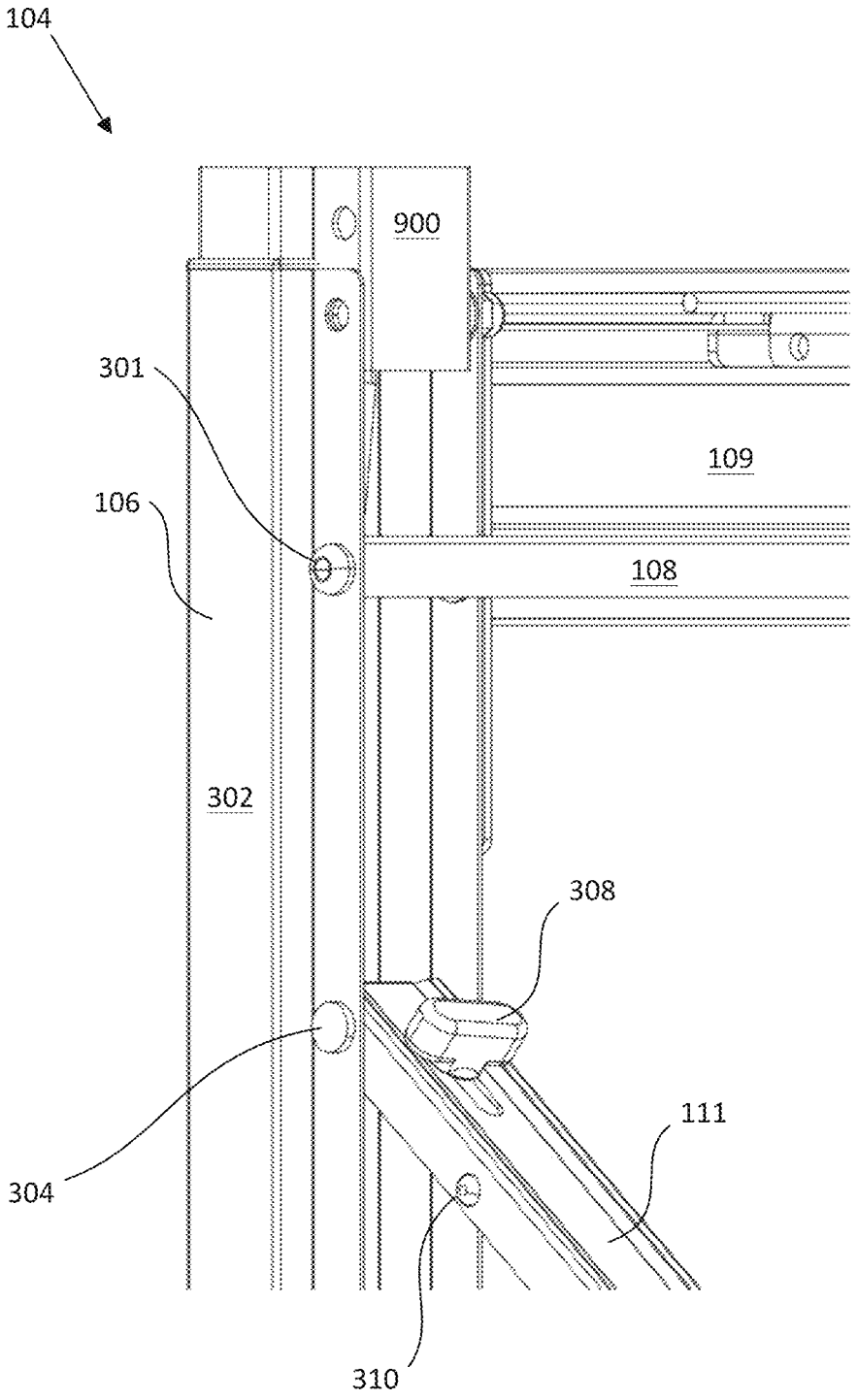
FIG. 3 is a perspective view diagram illustrating a partial view of the vertical member, according to examples of the subject disclosure.

FIG. 3 is a perspective view diagram illustrating a partial view of the vertical member 106, according to examples of the subject disclosure. The vertical member 106, in certain examples, is formed having a pair of opposing sidewalls 302 (or side portions) that extend outward from a face portion (not shown here). The face portion includes a plurality of openings which are configured to engage tabs formed in ends of the shelf beam 109. The opposing sidewalls 302 extend from the face portion and include multiple openings for receiving various fasteners 301 and locking pins 304. In other examples, openings formed in the sidewalls are useful for securing accessories to the rack system 100, including but not limited to, cord holders (see FIG. 13).

The cross members 108, in certain examples, are releasably and pivotally fastenable to a vertical member 106 using the fastener 301. This, beneficially, allows for the end support 104 to be efficiently packaged. Stated differently, if the cross members 108 were rigidly fastened (e.g., welded, etc.) to the vertical members 106, then the width of the end support 104 would necessarily have to match a depth of a shelf 102, and packaging would have to accommodate that width/depth. However, the cross members 108 may be detached from the vertical members 106 and packaged in a position that is substantially parallel to the vertical member 106. This allows for a much smaller package that has a width defined only by the shelf 102 instead of the shelf 102 and the end support 104. And, as will be described in greater detail below, the current disclosure contemplates a multi-part shelf that reduces by almost ½, or more, the width of the packaging necessary to package and ship the rack system 100.

In certain examples, the cross member 108 or diagonal member 111 may include a sliding lock mechanism 308. In certain other examples, each cross member 108 and diagonal member 111 includes a sliding lock mechanism 308 at each end. In other words, each connection between a vertical member 106 and the diagonal member 111 or the cross member 108 is secured with a sliding lock mechanism 308. The sliding lock mechanism 308, as will be described in greater detail below, may include a shuttle that is provided with an outer surface selected to engage an inner surface of a channel formed by the diagonal member 111 and slidably engage the channel to move between a locked position (see FIG. 3) and an unlocked position.

The sliding lock mechanism 308, in certain examples, includes a safety lock 310 that locks into an opening in the diagonal member 111, for example. The sliding lock mechanism 308 may be formed of spring steel that urges the tabs of the safety lock 310 outward. When the tabs encounter the opening in the diagonal member 111, the tabs pop into position and prevent the sliding lock mechanism 308 from moving relative to the diagonal member 111.

Also depicted is a coupling bracket 900 for connecting vertical members 106. Vertical members 106 may be manufactured in any suitable length. Typical lengths include, but are not limited to, 3', 4' 5', and 6'. In certain examples, the coupling bracket 900 may be disposed between two 3' vertical members 106 to achieve a 6' length. This beneficially allows for greater configuration options for a user, who is able to create 3' tall or 6' tall rack systems 100. As will be described in greater detail below with reference to FIG. 9, the coupling bracket 900 is formed with an exterior shape that is configured to slide into a channel formed by the vertical member 106. In other words, the coupling bracket 900 has an exterior surface profile that corresponds with an interior surface profile of the channel formed by the vertical member 106.

Figure 4:
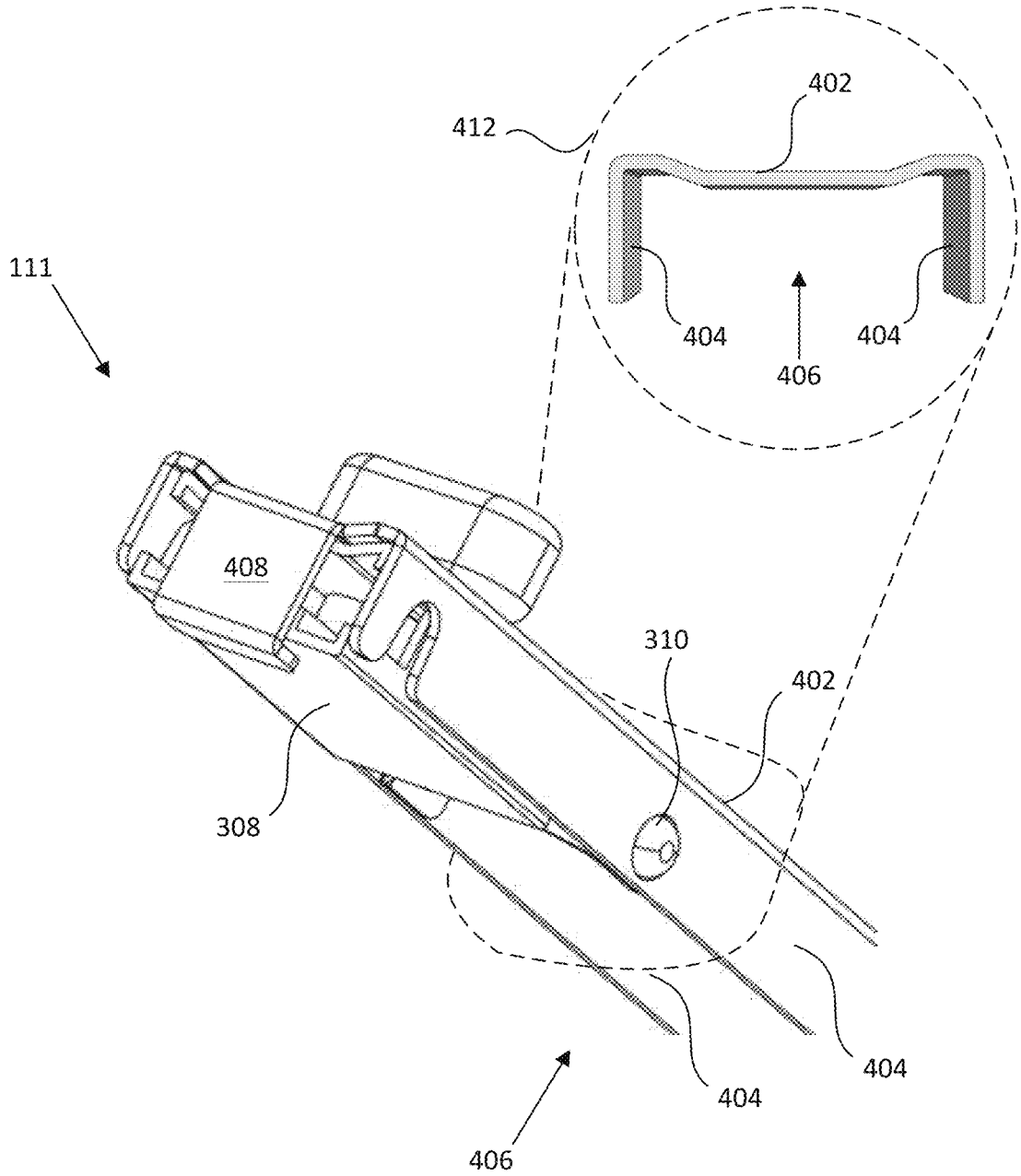
FIG. 4 is a perspective view diagram illustrating the diagonal member, according to examples of the subject disclosure.

FIG. 4 is a perspective view diagram illustrating the diagonal member 111, according to examples of the subject disclosure. The diagonal member 111, like many of the other supports and members, may be formed of a variety of materials, including but not limited to, polymers, metals, composites, etc. In certain examples, the diagonal member 111 is formed of steel in a generally "C" shaped cross-section to increase strength and reduce weight. In certain examples, the supports and cross-members may be formed with a closed hollow-body cross-section (e.g., square tube members). As depicted, the diagonal member 111 is formed with a base 402 and a pair of sidewalls 404 that extend from the base 402. The base 402 and the sidewalls 404 form a channel 406 which is configured to receive the sliding lock mechanism 308.

Also depicted is a stop tab 408 that extends from an end of the diagonal member 111 (or alternatively, from a cross member 108). The stop tab 408 may extend from the base 402 in the same direction as the sidewalls 404, however the stop tab 408 may define a plane that is perpendicular to planes defined by the sidewalls 404. The stop tab 408 is configured to function as a back stop for the sliding lock mechanism 308, and together the stop tab 408 and the sliding lock mechanism 308 substantially surround the locking pin 304, and lock the cross member 108 or the diagonal member 111 to the vertical member 106. When the lock mechanism 308 is in the locked position, as depicted in FIG. 4, the safety pin 310 pops into locking engagement with openings formed in the sidewalls 404 of the diagonal member 111. The safety pin 310 maintains the locking mechanism 308 in the locked position.

FIG. 4 also depicts a cross-sectional profile of the diagonal member 111 in callout window 412. Although described here as the diagonal member 111, this same cross-sectional profile may be applied to the cross members 108. The cross-sectional profile depicted in the callout window 412 generally depicts an open C-shaped profile having a base 402 and two sidewalls 404 extending from the base 402. The base 402 may include a strengthening surface characteristic, such as an offset face as depicted. Other bends and profiles are contemplated. Beneficially, this allows for a thinner metal to be used while retaining the same strength rating of a support member having a planar base 402, which reduces the overall weight and cost of the rack system 100 while maintaining the same load rating.

Figure 5:
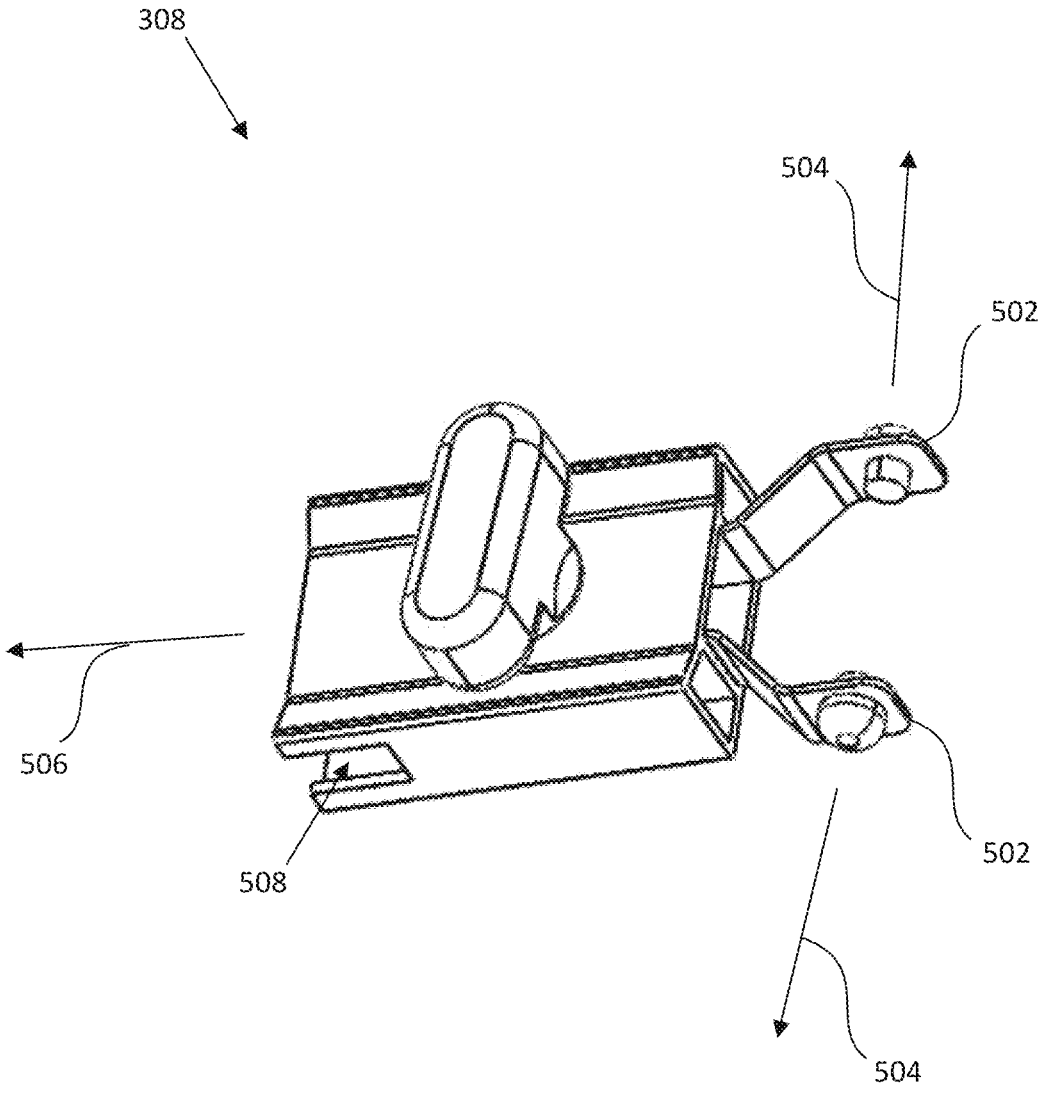
FIG. 5 is a perspective view diagram illustrating the sliding lock mechanism, according to examples of the subject disclosure.

FIG. 5 is a perspective view diagram illustrating the sliding lock mechanism 308, according to examples of the subject disclosure. The sliding lock mechanism 308, in certain examples, is formed with a shape configured to conform to a shape of the channel 406 of the diagonal member 111 (or the cross member 108). If the diagonal member 111 or the cross member includes a stiffening ridge (as is depicted in FIGS. 2 and 3), the sliding lock mechanism 308 includes a corresponding surface contour.

In certain examples, the safety lock 310 extends outward from the sliding lock mechanism 308. The safety lock 310 may include ears 502 that are coupled to the sliding lock mechanism 308. The ears 502 may be formed of spring steel and be biased outward laterally (e.g., substantially perpendicular to the longitudinal axis 506) as indicated by arrows 504. As used herein, the term "substantially" refers to plus or minus 10% of the referenced value. For example, when referring to "perpendicularly," or a 90-degree angle, "substantially perpendicularly" refers to a range between 81 and 99 degrees. As the sliding lock mechanism is moved longitudinally along an axis towards a locking position as indicated by arrow 506, the ears 502 will lock into place upon encountering an opening in the sidewall 404 of the cross member or diagonal support. A person may release the sliding lock mechanism 308 by simultaneously depressing the protrusions of each ear 502.

The sliding lock mechanism 308, in certain examples, includes a cutout portion 508 that surrounds a locking pin 304 of the vertical member 106. When in the locked position, the sliding lock mechanism 308 contacts the stop tab 408 which encloses the locking pin 304, as is described below in greater detail.

Figure 6:
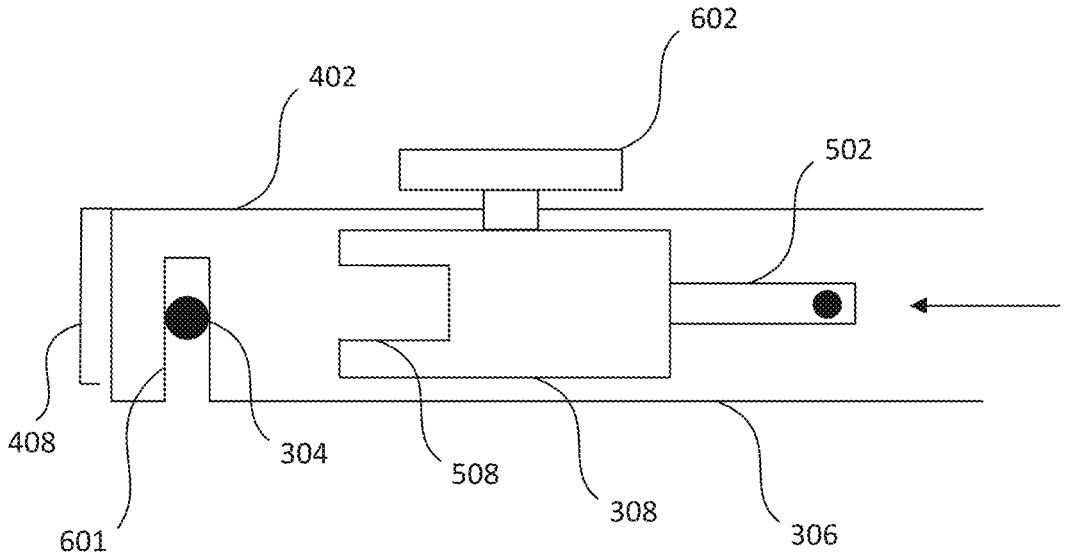
FIG. 6 is a schematic block diagram illustrating a cross-sectional view of the support member (either cross member or diagonal member) engaging the locking pin of the vertical member, according to examples of the subject disclosure.

FIG. 6 is a schematic block diagram illustrating a cross-sectional view of the support member (either cross member 108 or diagonal member 111) engaging the locking pin 304 of the vertical member 106, according to examples of the subject disclosure. During assembly of the rack system 100, a first end of the support member, which may be pivotally connected at a second end to a vertical support, is lowered onto the locking pin 304. A cutout portion 601 in sidewalls of the support member engages the locking pin 304 on three sides. Stated differently, in the depicted example, the cutout portion 601 contacts the locking pin 304 on the top and sides of the locking pin, but leaves the bottom exposed. The sliding lock mechanism 308, as described above, is movable relative to the support member into a locking position that surrounds the locking pin 304 (i.e., secures the exposed bottom side of the locking pin 304) or an unlocked position that allows the detachment of the support member from the vertical member 106.

In certain examples, the sliding lock mechanism 308 includes a knob 602 for increasing or decreasing the sliding resistance of the sliding lock mechanism 308 within the support member. The knob 602 may thread through a slot formed in the base 402 of the support member, and upon tightening the knob 602 draw the sliding lock mechanism 308 towards the base 402. This beneficially prevents the sliding lock mechanism 308 from rattling around inside the channel and/or potentially falling out of the channel.

Figure 7:
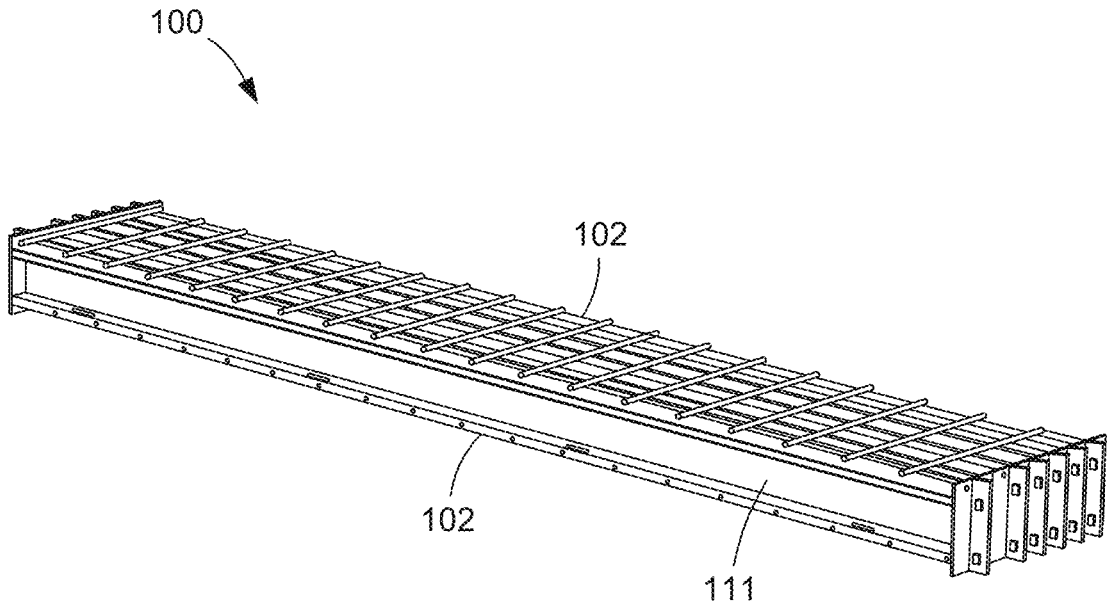
FIG. 7 is a perspective view diagram of the rack system, according to examples of the subject disclosure.

FIG. 7 is a perspective view diagram of the rack system 100, according to examples of the subject disclosure. The rack system 100, as discussed above, is collapsible into a compact package due to the unique coupling system that locks a cross member or diagonal support to a vertical member to form the end supports 104. Depicted are trifold or bi-fold shelves that also reduce a packages width, and beneficially, cross members and diagonal supports that nest into the shelf supports to reduce the packages height. The end supports 104 (not visible here) are nestable within channels formed by the shelf beams 109. Shelves 102 are positionable on the top and bottom, as depicted, and the entire rack system 100 is packaged in a package that was not possible with common rack systems.

Figure 8:
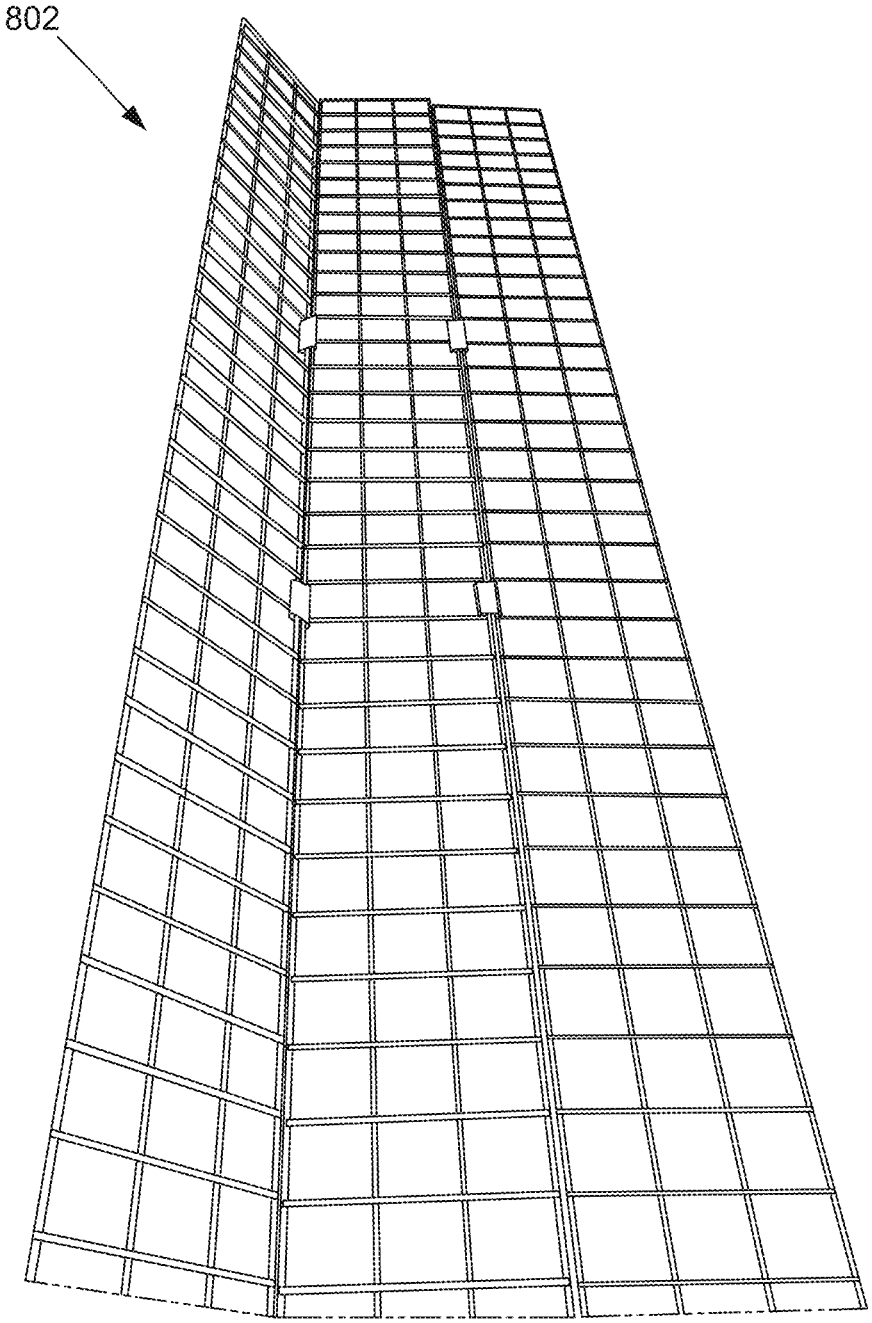
FIG. 8 is a perspective view drawing of a foldable shelf, according to examples of the subject disclosure.
Figure 18B:
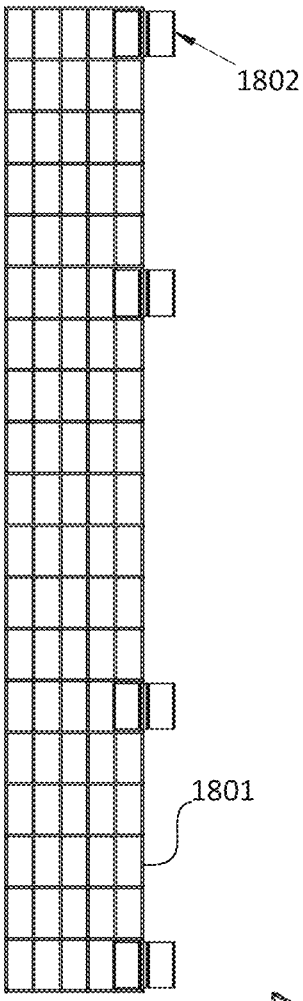
FIG. 18*a*-18*d* are diagrams illustrating a split shelf and coupler, in accordance with examples of the subject disclosure.
Figure 18C:
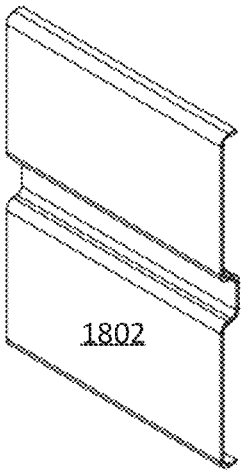

FIG. 8 is a perspective view drawing of a foldable shelf 802, according to examples of the subject disclosure. The foldable shelf 802, in certain examples, is a wire mesh shelf that is formed of three equal sized portions. However, two or more (e.g., 2, 3, 4, 5, etc.) portions are also contemplated. Hinge couplings may join together the shelf portions and allow the foldable shelf 802 to collapse to a third of its original size by folding the portions on top of each other. This beneficially allows for much narrower packaging as was depicted in FIG. 7. Cross braces (see FIG. 1) are disposed along the length of the foldable shelf between the foldable shelf and the shelf beam 109 to support the foldable shelf 802 when in an extended configuration (as opposed to a folded or collapsed configuration as in FIG. 7). Alternative devices for implementing a shelf are described below in greater detail with reference to FIGS. 18*a*-18*c*.

Figure 9:
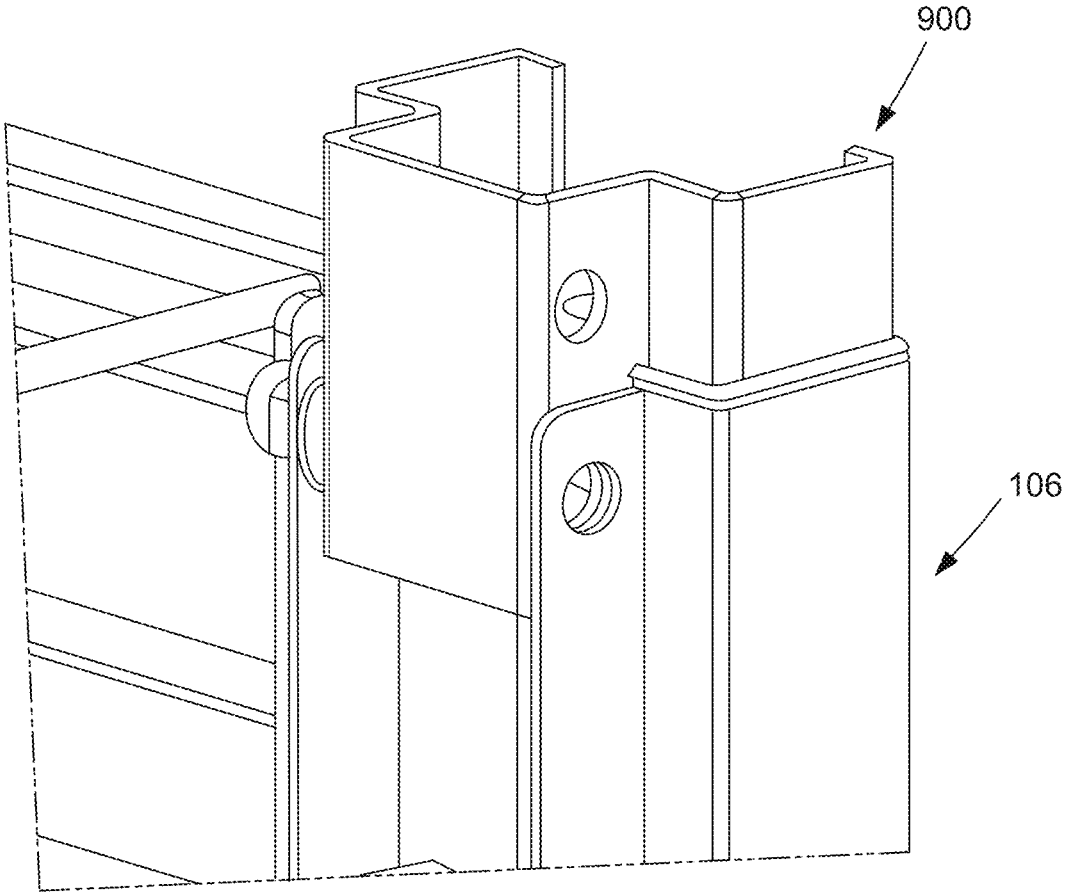
FIG. 9 is a perspective view diagram illustrating the stacking bracket, according to examples of the subject disclosure.

FIG. 9 is a perspective view diagram illustrating the stacking bracket 900, according to examples of the subject disclosure. The stacking bracket 900, in certain examples, is configured to permit the stacking of rack systems 100. Accordingly, two 3-foot-tall rack systems 100 may be stacked to create a 6-foot-tall rack system. The stacking bracket 900 is shaped with a cross-sectional profile that is selected to be insertable into the end of a vertical member 106, as depicted. Fasteners (e.g., a nut and bolt) may secure the stacking bracket 900 to the upper and lower vertical members 106. In other examples, a spring-loaded mechanism similar to the ears 502 of the sliding lock mechanism may be implemented to secure the stacking bracket 900 to one or both vertical members 106.

Figure 10A:
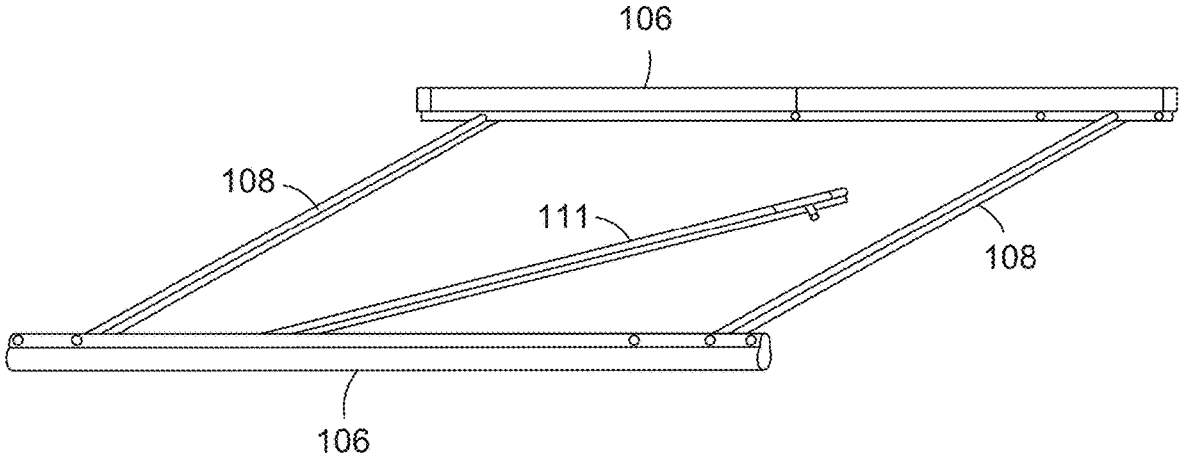
FIGS. 10*a*, 10*b*, and 10*c* are side view diagrams of the end support, according to examples of the subject disclosure.
Figure 10B:
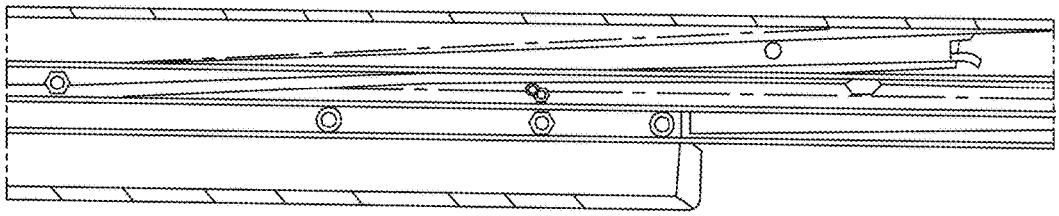
Figure 10C:
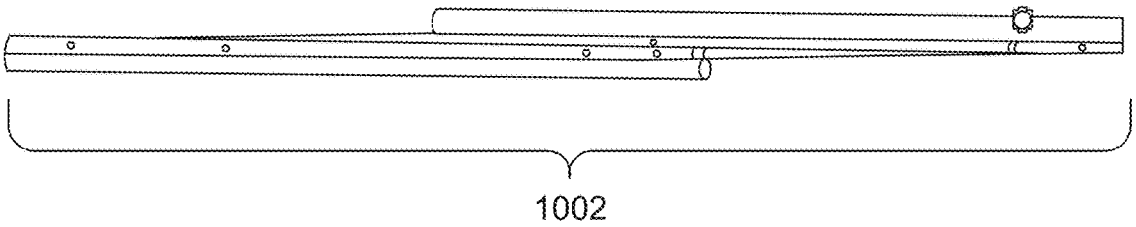

FIGS. 10*a*, 10*b*, and 10*c* are side view diagrams of the end support 104, according to examples of the subject disclosure. The end support 104 may include one or more cross members 108 and one or more diagonal members 111. The depicted embodiment illustrates a 3-foot-high rack system 100 end support 104 having two cross members 108 and a single diagonal member 111. In this example, the cross members 108 may be packaged from a factory fully fastened to opposing vertical members 106, using pivotable fasteners such as a bolt, to the vertical members 106. The diagonal member 111 may be fastened at the factory at one end. When collapsed, as shown in FIGS. 10*b* and 10*c*, the overall length 1002 is less than 6 feet. When in the collapsed position, the vertical members 106 are disposed adjacent to each other, but offset, as depicted. In other words, when collapsed, the ends of each of the vertical members 106 are not aligned like when in the expanded position, but instead they are offset a distance from each other. This, beneficially, allows for the end supports 104 to be packaged with 6-foot-long foldable or split shelves without needing to extend the packaging beyond a length that is required to package the shelves. By shipping the end supports in this manner, the end user only needs to "open" or expand the end support 104 to the fully extended position, and use the sliding lock mechanism 308 to lock the diagonal member 111 to an opposing vertical member 106. This locks the end support 104 into a usable configuration that is ready to connect to shelf beams 109 in a matter of 20 seconds or less. This is a vast improvement over the typical rack system that is available at home improvement stores, for example, which can take 30 minutes or more to assemble.

Figure 11A:
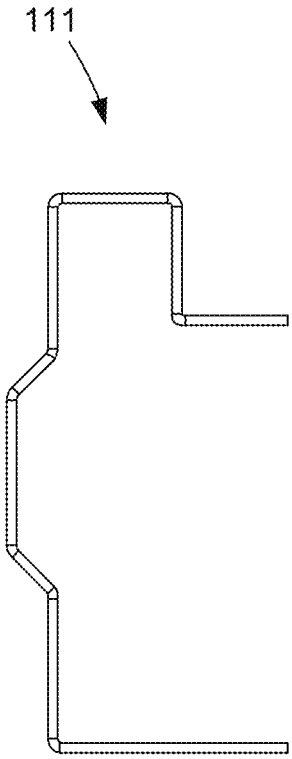
FIGS. 11*a*, 11*b*, and 11*c* are cross-sectional diagrams of a shelf support, according to examples of the subject disclosure.
Figure 11B:
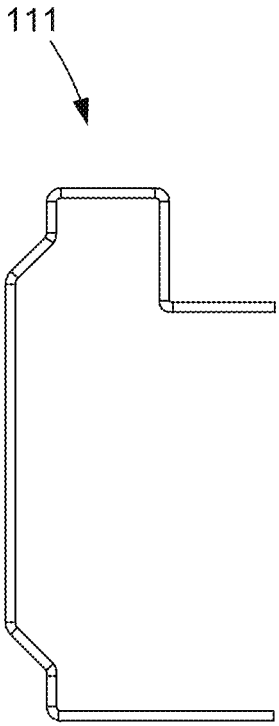
Figure 11C:
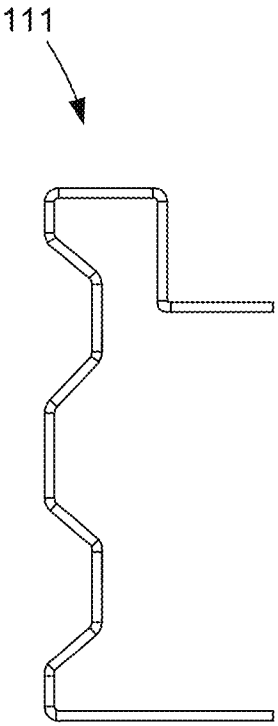

FIGS. 11*a*, 11*b*, and 11*c* are cross-sectional diagrams of a shelf support 109, according to examples of the subject disclosure. The shelf support depicted in FIG. 2 may be provided with different cross-sectional profiles. Although three variations are depicted here, others are contemplated. Beneficially, an added surface feature increases the strength of the shelf support 200 and allows for a thinner material to be used, which decreases the weight of the rack system 100. As depicted, the added bends still allow for a channel to be formed, which is usable for receiving the end supports 104 for compact packaging purposes.

Figure 12:
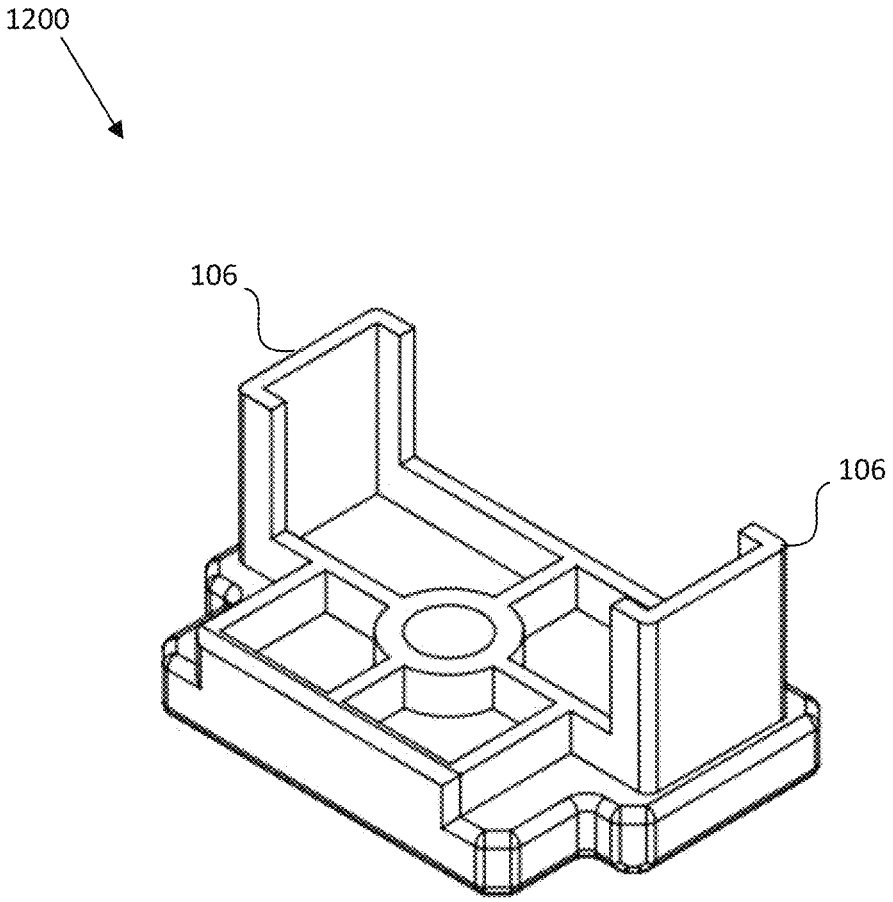
FIG. 12 is a perspective view diagram of a foot, according to examples of the subject disclosure.

FIG. 12 is a perspective view diagram of a foot 1200, according to examples of the subject disclosure. The foot 1200 may also function as a cap, and is insertable into ends of the vertical members 106 of the end support 104. In certain examples, the foot 1200 is formed of a rigid polymer material. Alternatively, the foot 1200 may be formed of any suitable material that is capable of supporting the weight of the rack system 100 and its contents. Additionally, during packaging and shipping, the foot 1200 functions as an internal bumper that protects the end supports 104 and the shelf beams 109. In other words, when the end support 104 is nested within a shelf beam 109, the foot 1200 provides a bumper between an end of the end support 104 and an end of the shelf beam 109. During shipping the end supports 104 might slide back and forth within the shelf beams 109, and foots 1200 prevent damage. The foot 1200 also prevents sharp edges of the end supports 104 from damaging packaging materials, such as a packaging box.

The foot 1200, in certain examples, is configured and dimensioned to be a friction fit within the channel formed by the vertical member 106. Flanges 1202 extending upward from a foot base 1204 are spaced apart a distance that is selected to cause the flanges 1202 to engage interior surfaces of the channel formed by the vertical member 106. The foot base 1205 is formed with a shape that is selected to correspond with a cross-sectional profile of the vertical member 106 (see FIG. 9). The ends of the vertical members 106 are configured to receive the foot 1200, or the coupling bracket 900 as described above.

Figure 13:
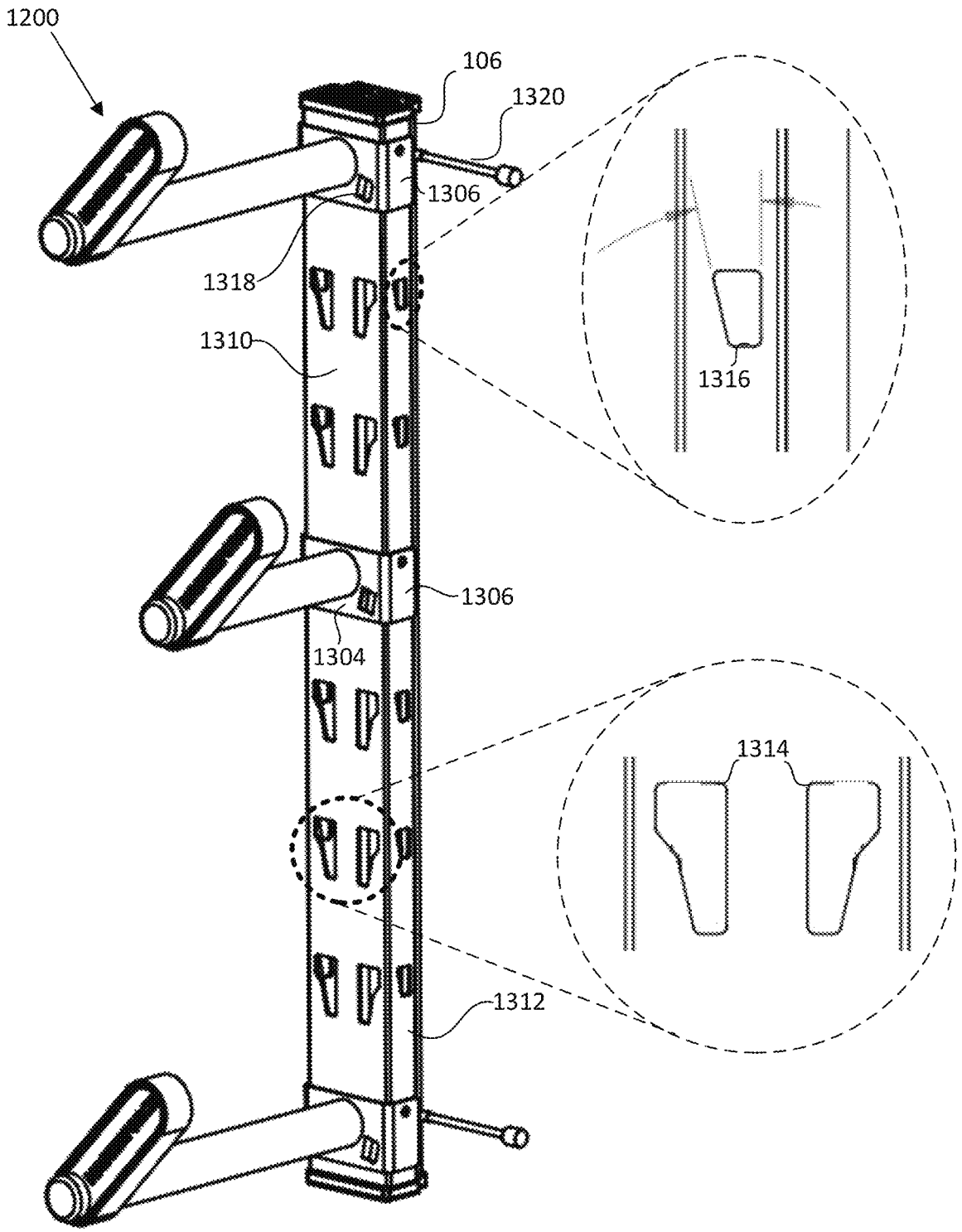
FIG. 13 is a perspective view diagram of a vertical member, in accordance with examples of the subject disclosure.
Figure 14A:
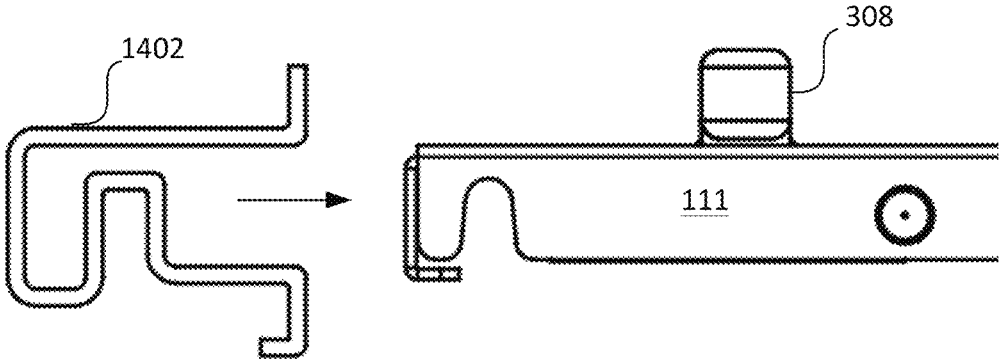
FIGS. 14*a*-14*d* are perspective view diagrams illustrating components for aiding in the protection of the rack system during packaging and shipping, in accordance with examples of the subject disclosure.
Figure 14B:
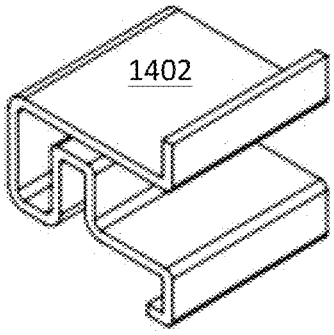
Figure 14C:
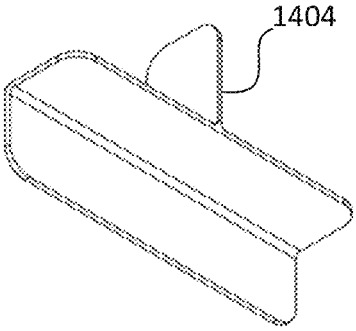
Figure 14D:
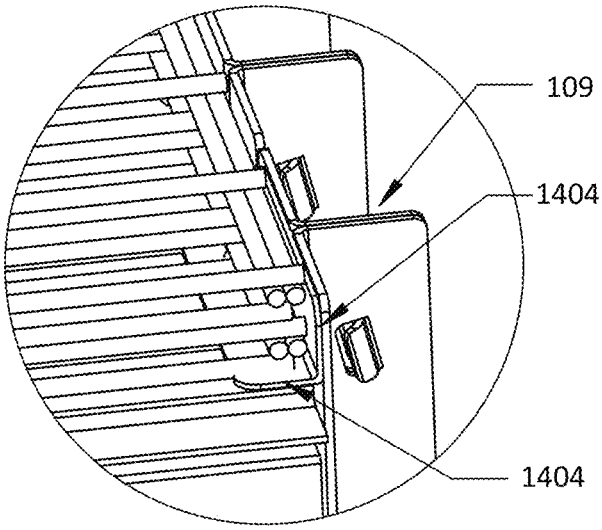

FIG. 13 is a perspective view diagram of a vertical member 106, in accordance with examples of the subject disclosure. The vertical member 106, in certain examples, is provided with attachment accessories 1302. The attachment accessories 1302 may be configured for any number of purposes, including but not limited to, cord minders (as depicted), tool holders, towel holders, etc. It is contemplated that an attachment accessory may be adapted for any suitable purpose.

The attachment accessory 1302, in certain examples, includes a base 1304 and side flanges 1306 that are dimensioned to interface with the vertical member 106. In other words, the width of the base 1304 is slightly larger than a face portion 1310 of the vertical member 106 so that the side flanges 1306 engage the side portions 1312 of the vertical member 106. In certain examples, the vertical member 106 is configured with openings 1314 in the face portion 1310 and openings 1316 in the side portion 1312. The openings 1314, depicted in the callout for the sake of clarity, are useful for coupling the vertical member 106 with the shelf beam 109 or the attachment accessory 1302. The openings 1314 engage tabs 1318 formed in the attachment accessory 1302. Similar tabs are formed in the end portions of the shelf beam 109, as will be described below in greater detail.

The tabs 1318 may be formed by punching a tab from the metal of the base 1304. In the alternative, the tabs 1318 are fastened to the base 1304 by, for example, welding. The tabs 1318, in certain examples, are positioned on the base 1304 to correspond with the openings 1314 in the face portion 1310. As the user slides the attachment accessory 1302 downward, the tabs 1318 engage the angled portions of the openings 1314 and wedge the tabs 1318 into the openings 1314. The attachment accessory 1302 can only then be removed by lifting the attachment accessory 1302 upward.

In certain examples, a pin 1320 is insertable through an opening in the side flange 1306 that passes through openings 1316 in the side portions 1312 of the vertical member 106. The pin 1320 is of a sufficient length to pass from one side portion 1306 of the attachment accessory to the opposing side flanges or portion 1306. The pin 1320 is configured to lock the attachment accessory to the vertical member 106. Additionally, the pin 1320 "cinches" the attachment accessory 1302 to the face portion 1310 and creates an interface that does not wobble or rattle. This, beneficially, is due to an angled portion of the opening 1316 that angles away from the face portion 1310. As downward pressure is applied to the attachment accessory 1302, the angled portion causes the pin 1320 to move away from the face portion 1310, which in turn tightens the attachment accessory 1302 to the face portion 1310. In certain examples, the angle of the angled portion is in the range of between about 10 and 20 degrees. In other examples, the angle is about 13 degrees.

FIGS. 14*a*-14*d* are perspective view diagrams illustrating components for aiding in the protection of the rack system 100 during packaging and shipping, in accordance with examples of the subject disclosure. In certain examples, the rack system 100 may be provided with end caps 1402 for the diagonal member 111 (see FIGS. 14*a* and 14*b*). The end caps 1402, in certain examples, are formed of a material that is capable of protecting the end of the diagonal member 111 during transportation. The end caps 1402, for example, may be formed of cardboard or rubber. Another benefit of the end cap 1402 is that the end cap 1402 is configured to maintain the lock mechanism 308 in the open or unlocked position. This beneficially improves assembly time by not requiring the user to unlock the locking mechanism 308.

Also depicted is a wire grid bumper 1404 that is insertable between stacked shelves. Beneficially, the wire grid bumper 1404 protects the wire deck shelves from damaging the inside of a shelf beam 109 and prevents contact between the ends of the shelf beams 109. The wire grid bumper 1404 is configured with multiple flanges that extend perpendicularly from each other, and are useful fore preventing contact between components, in different planes, of the rack system 100 during packaging and shipping. Once assembled, the user may discard of the end cap 1402 and the wire grid bumper 1404.

FIGS. 15*a*-16*c* are various diagrams of a cross support 1500 for shelves, in accordance with examples of the subject disclosure. Various configurations and implementations are depicted, and discussed jointly. The cross support 1500 is configured to span from a first shelf beam 109 to an opposing second shelf beam 109 and provide lateral support to the shelves 102. One or more cross supports 1500 may be implemented based on an anticipated weight load of the shelf 102. The cross supports 1500, in certain examples, are formed of sheet metal formed in a C-channel configuration, as depicted (e.g., FIG. 15*b*). The height of the cross support 1500 is selected to allow the cross-support to be inserted inside the channel 1504 of the shelf beam 109 (see FIG. 15*d*). This is useful for shipping as the cross support 1500 may be nested within the shelf beam 109. This is also useful for assembly as the shelf beam 109 supports each end of the cross support 1500.

In certain examples, the cross support 1500 is formed with cut outs 1505 and surface features 1506. Cut outs 1505 and surface features 1506 increase rigidity of the cross support 1500. For example, a raised or off-set planar area (see feature 1506 of FIG. 15*a*) may be formed by stamping the feature 1506 in the cross support 1500. The cut outs 1502 may be formed with folded over tabs 1508 to also increase rigidity. Another benefit of the folded over tabs 1508 and the cut outs 1505 is for portability of the rack system 100 when packaged. For example, when packaged, the cross supports 1500 may be positioned near an edge of the packaging and the cut outs 1505 may be used as hand holds for carrying the packaged rack system 100.

Figure 15A:
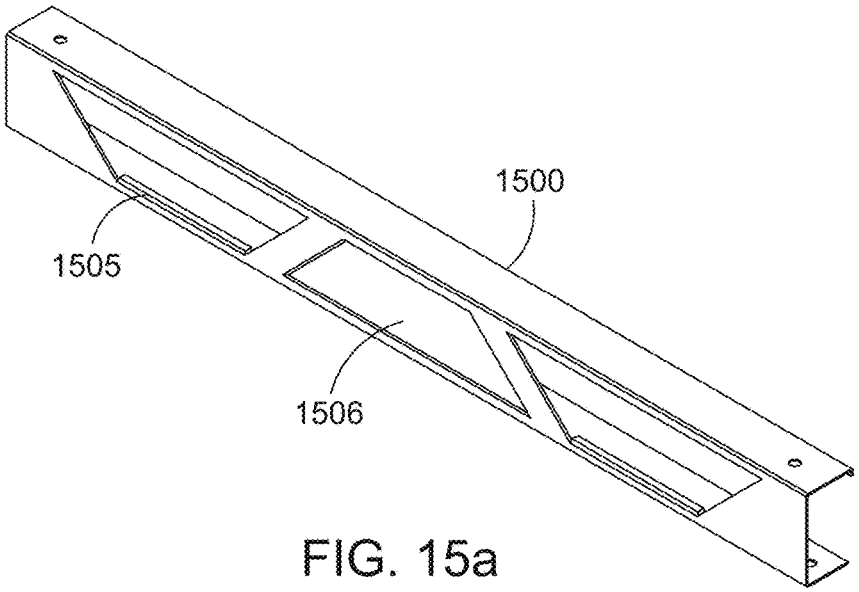
FIGS. 15*a*-*d* and 16*a*-16*c* are various diagrams of a cross support for shelves, in accordance with examples of the subject disclosure.
Figure 15B:
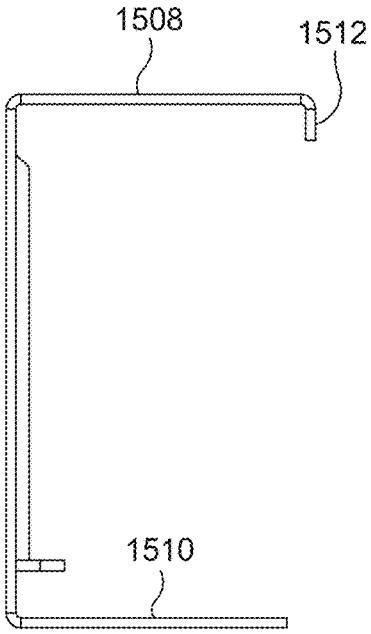
Figure 15C:
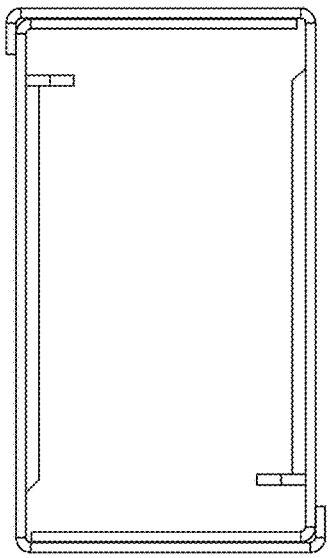
Figure 15D:
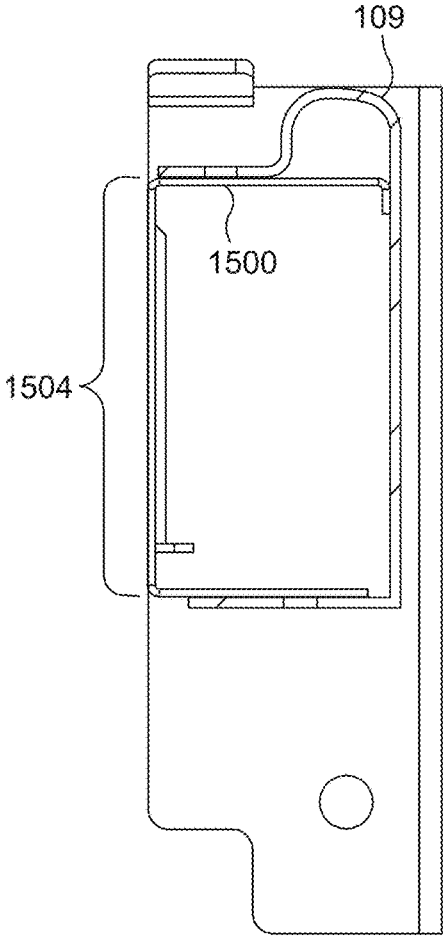
Figure 16A:
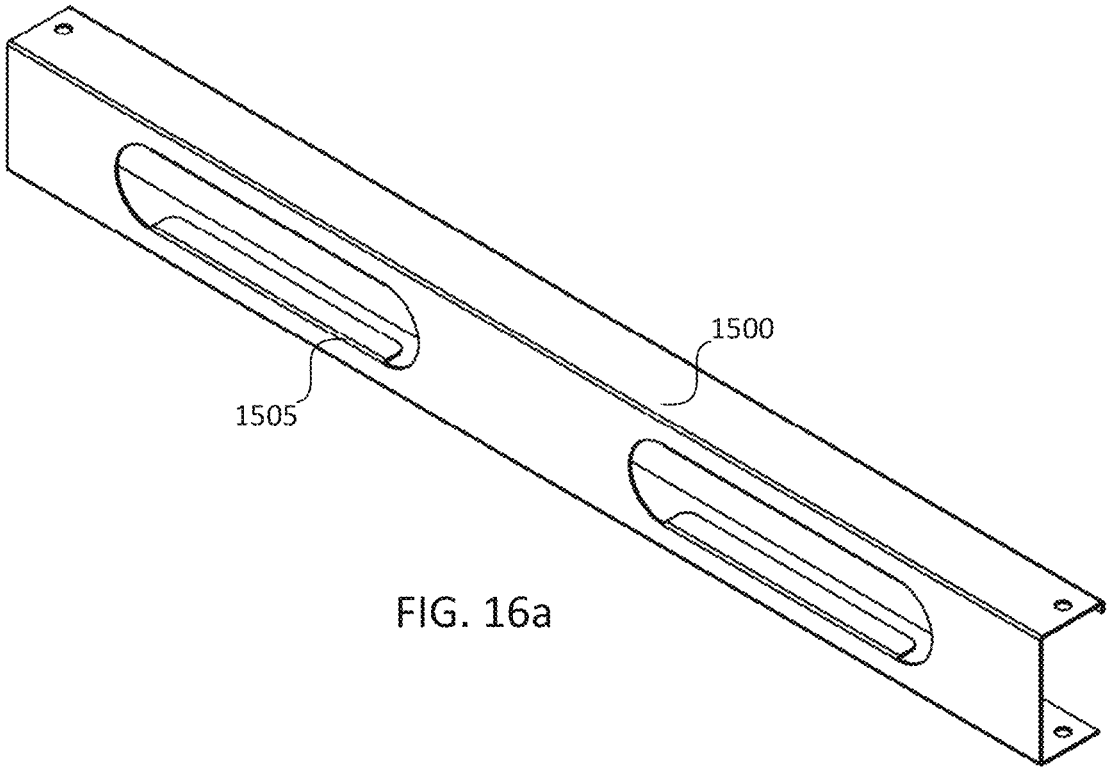
Figure 16B:
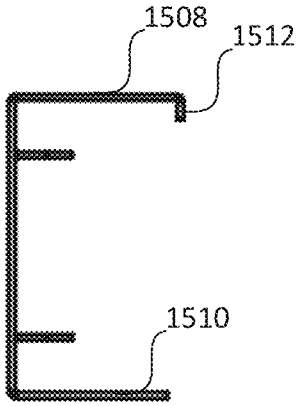
Figure 16C:
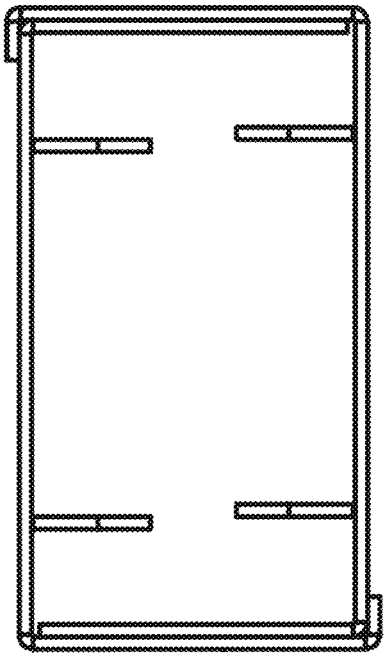

In certain examples, the cross support 1500 includes two side tabs 1508, 1510 that form the C-channel cross section (see FIGS. 15*b* and 16*b*). In certain examples, the cross support 1500 includes a first side tabs 1508 that is longer than the second side flange 1510. This beneficially allows for the cross supports 1500 to nest within each other (see FIGS. 15*c* and 16*c*). In certain examples, at least one of the side flanges includes a downwardly extending lip 1512 to increase rigidity.

Figure 17B:
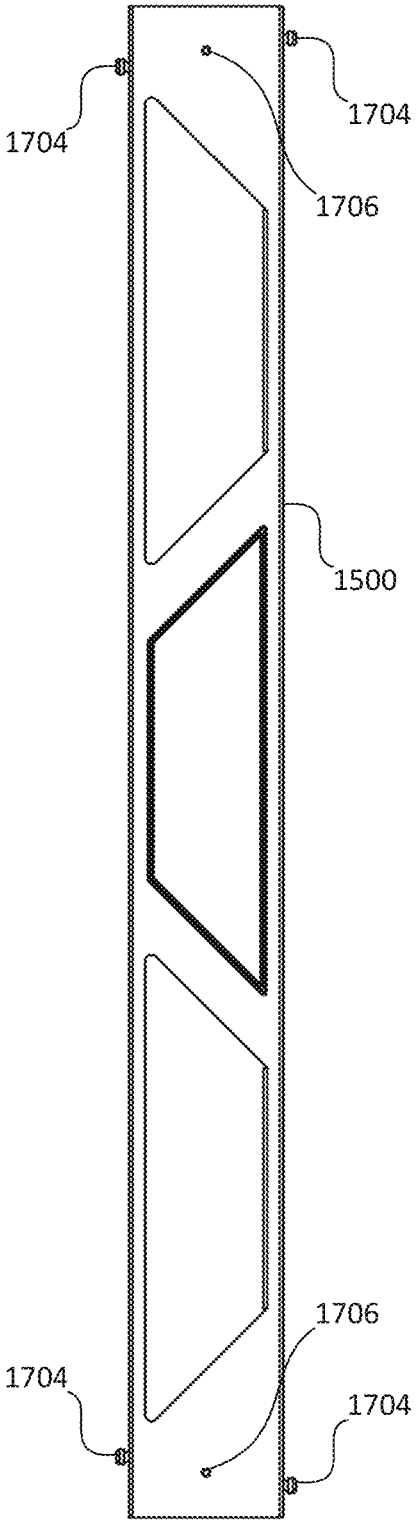
FIGS. 17*a*-17*c* are diagrams illustrating a cross support connection system, in accordance with examples of the subject disclosure.
Figure 17A:
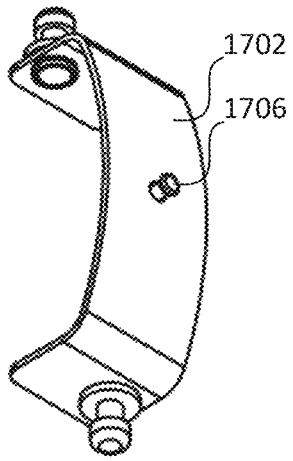
Figure 17C:
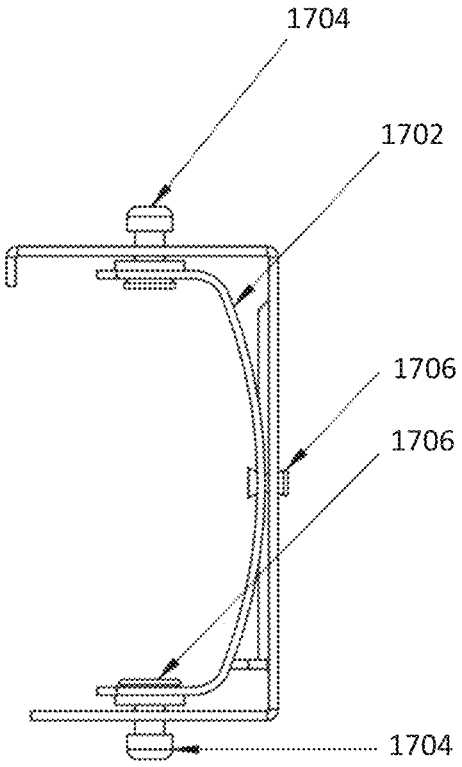

FIGS. 17*a*-17*c* are diagrams illustrating a cross support connection system 1700, in accordance with examples of the subject disclosure. A spring clip 1702 may be positioned at each end of the cross support 1500 for quickly coupling the cross support 1500 with the shelf beams 109. Each spring clip 1702 may have one or more outwardly protruding buttons that pass through openings in the cross support 1500. The spring clip 1702 is formed of spring steel that allows the user to depress the buttons 1704 to allow for the coupling/decoupling of the cross support 1500 to the shelf beams 109.

In certain examples, the spring clip 1702 is coupled to the cross support 1500 with a fastener 1706, such as a rivet. The button 1704 may also be coupled with the spring clip 1702 via a fastener 1706. Alternatively, the buttons 1704 are integrally formed with the spring clip 1702. In use, the user will depress the buttons 1704 to insert the cross support 1500 inside the channel 1504 of the shelf beam 109. The buttons 1704 will pop into place once encountering openings formed in the shelf beam 109, and thereby lock the cross support 1500 to the shelf beam 109. The cross supports 1500 are positioned in a generally perpendicular relationship with relation to the shelf beams 109.

FIG. 18*a*-18*d* are diagrams illustrating a split shelf 1800 and coupler 1802, in accordance with examples of the subject disclosure. The split shelf 1800, in certain examples, is formed of two or more wire-grid shelf pieces. The depicted embodiment shows a split shelf 1800 formed of two halves, although 3 or more shelf portions are contemplated. The split shelf 1800 may be joined with shelf couplers 1802. In certain examples, the shelf coupler 1802 is rigidly mounted to a first shelf half (see FIG. 18*b*) by the manufacturer. For example, the shelf coupler 1802 may be welded to the first shelf half 1801.

Figure 18D:
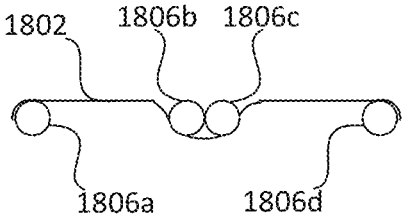
Figure 18A:
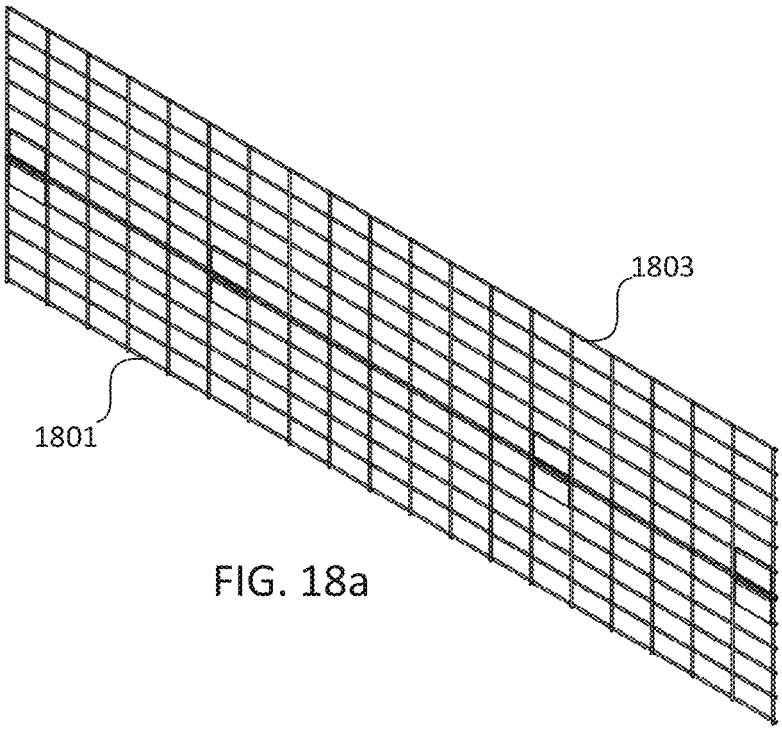

The shelf coupler 1802, in certain examples, is a substantially planar coupler that is configured to engage four wires of the slit shelf 1800 (see FIG. 18*d*). By positioning two wires 1806 under the shelf coupler 1802, and two wires over, the shelf coupler 1802 provides rigidity to the centerline of the joined shelf halves. In certain examples, the shelf coupler 1802 is welded to wire(s) 1806*a* and/or 1806*b* of a left shelf half 1801 (see FIGS. 18*b* and 18*d*). The right shelf half 1803 is removably coupled with the shelf coupler 1802 to form the entire split shelf 1800 (see FIG. 18*a*).

Figure 19A:
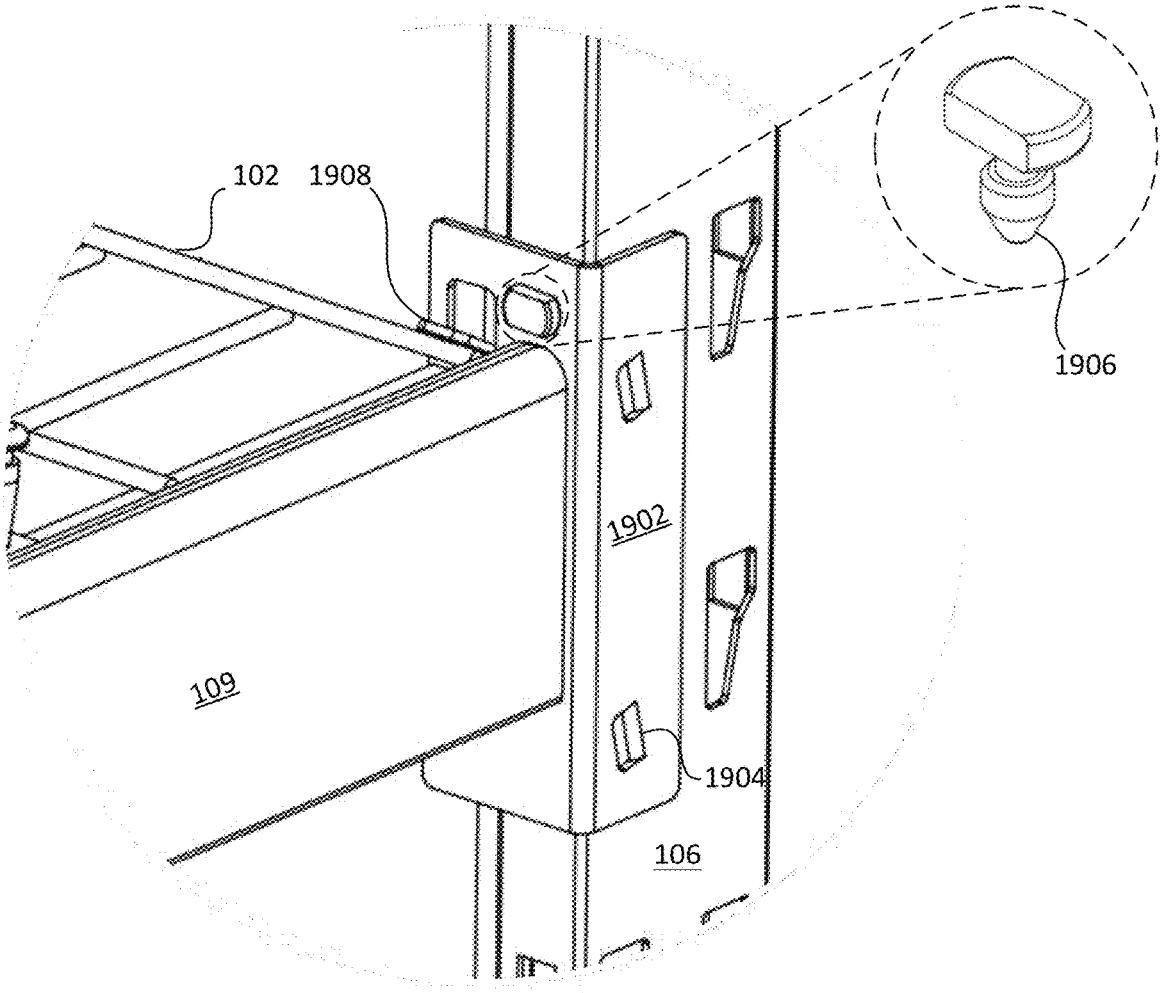
FIG. 19*a*-19*c* depict shelf beam couplers, according to examples of the subject disclosure.
Figure 19B:
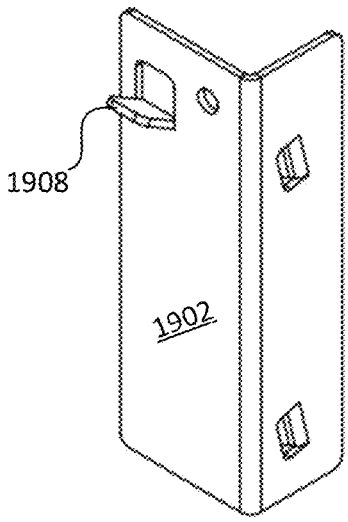
Figure 19C:
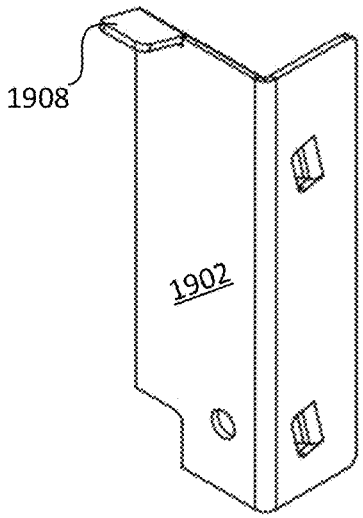

FIG. 19*a*-19*c* depict shelf beam couplers 1902, according to examples of the subject disclosure. Shelf beam couplers 1902, in certain examples, are attached at each end of the shelf beam 109 and couple the shelf beam 109 to the vertical member 106. Shelf beam coupler 1902 may be welded to the shelf beam 109. In certain examples, each shelf beam coupler 1902 includes tabs 1904 for engaging openings in the vertical member 106, as described above.

In certain examples, a locking plug 1906 may be inserted into an opening in the shelf beam coupler 1902 to prevent movement of the shelf beam coupler 1902 relative to the vertical member 106. The locking plug 1906 may include wrench flats, as depicted, for ease of removal by a wrench when necessary. Beneficially, the chamfered surface of the locking plug 1906 align openings of multiple layers of material, such as the shelf beam coupler 1902 and the vertical member 106. A step in the locking plug 1906 prevents the locking plug 1906 from accidentally coming out of engagement with the vertical member 106. The locking plug 1906 is usable in other areas of the rack system 100, for example, for connecting the cross support to the shelf beam, etc. The opening in the shelf beam coupler 1902 may be positioned at the top, as in FIGS. 19*a* and 19*b*, or near the bottom, as depicted in FIG. 19*c*.

In certain examples, the shelf beam coupler 1902 includes a shelf tab 1908 for holding shelves 102 in place, and preventing shelf warping of the decking that may occur when items are placed on the shelf 102. The shelf tab 1908 extends outward from the shelf beam coupler 1902 towards the shelf 102, as depicted. Other mechanisms for preventing shelf warping are contemplated.

This description uses examples to describe embodiments of the disclosure and also to enable any person skilled in the art to practice the embodiments, including making and using any devices or systems and performing any incorporated methods. The patentable scope of the disclosure is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A rack system comprising:

one or more elongated shelves, where each of the one or more elongated shelves includes a first end and a second end; and a pair of end supports, each of the pair of end supports configured to support either the first end or the second end of the one or more elongated shelves, where each of the pair of end supports comprises:

a first vertical member and a second vertical member, a corresponding upper cross member pivotally coupled at a first end to each first vertical member;

a corresponding lower cross member pivotally coupled at a first end to each first vertical member;

a diagonal support having a first end pivotally connected to the second vertical member; and a second end of each upper cross member selectively coupled to a respective second vertical member via a sliding lock mechanism, a second end of each lower cross member selectively coupled to a respective second vertical member via a sliding lock mechanism, and a second end of each diagonal support is selectively coupled to a respective first vertical member via a sliding lock mechanism;

wherein each sliding lock mechanism comprises:

a shuttle and at least one ear extending outwardly from the shuttle, the sliding lock mechanism being configured to move between an unlocked position and a locked position relative to its respective upper cross member, lower cross member and diagonal support;

wherein, when the sliding lock mechanism moves from the unlocked position to the locked position, the at least one ear moves from a retracted position corresponding to the at least one ear being disposed internal with respect to the respective upper cross member, lower cross member and diagonal support, and an extended position corresponding to the at least one ear extending at least partially through the respective upper cross member, lower cross member and diagonal support, in order to lock the sliding lock mechanism in place.

2. The rack system according to claim 1, wherein the at least one ear comprises a first ear and a second ear.

3. The rack system according to claim 2, wherein the first ear and second ear are biased outwardly from one another.

4. The rack system according to claim 1, wherein said sliding lock mechanism further comprises a knob extending outwardly from said shuttle for engagement by a user in moving said shuttle between said unlocked and locked positions.

5. The rack system according to claim 1, wherein said knob is adjustably connected to said shuttle.

6. The rack system according to claim 1, wherein each of said first and second vertical members are C-shaped and define a recessed channel.

7. The rack system according to claim 6, wherein said upper and lower cross members are pivotally locatable into the C-shaped channels of their first vertical members when not pivotally connected to the respective second vertical members.

8. The rack system according to claim 7, wherein said diagonal support is pivotally locatable into the C-shaped channels of their second vertical members when not pivotally connected to the respective first vertical members.

9. The rack system according to claim 1, wherein each of said upper cross members, lower cross members and each diagonal support is generally "C" shaped, having a base and a first side wall and a second side wall and a channel between said first and second side walls and wherein said shuttle is located between said first and second side walls.

10. The rack system according to claim 8, wherein said shuttle has a top, a bottom, a first side and a second side, said at least one ear comprises a first ear extending outwardly from said first side of said shuttle for engagement with said first side wall of said upper cross member, lower cross member or diagonal support, and a second ear extending outwardly from said second side of said shuttle for engagement with said second side wall of said second cross member, lower cross member or diagonal support.

11. The rack system according to claim 8, wherein said first and second ears are biased outwardly of said respective first and second sides of said shuttle.

12. The rack system according to claim 8, wherein said first ear comprises a first head for selective engagement with a first aperture in said first side wall and said second ear comprises a second head for selective engagement with a second aperture in said second side wall.

13. The rack system according to claim 1, wherein said shuttle comprises a body having a top, a bottom, a first end, a second end, a first side and a second side and a slot extending into said first end for receiving a pin of said first vertical member or said second vertical member.

14. A method of using a rack system comprising the steps of:

providing a rack comprising:

one or more elongated shelves, where each of the one or more elongated shelves includes a first end and a second end; and a pair of end supports, each of the pair of end supports configured to support either the first end or the second end of the one or more elongated shelves, where each of the pair of end supports comprises:

a first vertical member and a second vertical member, a corresponding upper cross member pivotally coupled at a first end to each first vertical member;

a corresponding lower cross member pivotally coupled at a first end to each first vertical member;

a diagonal support having a first end pivotally connected to the second vertical member; and a second end of each upper cross member selectively coupled to a respective second vertical member via a sliding lock mechanism, a second end of each lower cross member selectively coupled to a respective second vertical member via a sliding lock mechanism, and a second end of the diagonal support is selectively coupled to a respective first vertical member via a sliding lock mechanism;

wherein each sliding lock mechanism comprises:

a shuttle and at least one ear extending outwardly from the shuttle, the sliding lock mechanism being configured to move between an unlocked position and a locked position relative to its respective upper cross member, lower cross member and diagonal support;

moving said sliding lock mechanism from the unlocked position to the locked position to cause said at least one ear to move from a retracted position corresponding to the at least one ear being disposed internal with respect to the respective upper cross member, lower cross member and diagonal support, to an extended position corresponding to the at least one ear extending at least partially through the respective upper cross member, lower cross member and diagonal support.

15. The method according to claim 14, wherein said shuttle has a first end with a slot extending inwardly and said step of moving causes said shuttle to be moved to a position in which a pin associated with said respective upper cross member, lower cross member and diagonal support to be located in said slot.

16. The method according to claim 14, further comprising moving said sliding lock mechanism from the locked position to said unlocked position.

17. The method according to claim 14, wherein said step of moving comprises applying a force to a button which extends outwardly from said shuttle.

18. The method according to claim 14, further comprising the step of rotating said respective upper cross member, lower cross member and diagonal support from a first stowed position to a second extended position before said moving step.

19. A rack system comprising:

one or more elongated shelves, where each of the one or more elongated shelves includes a first end and a second end; and a pair of end supports, each of the pair of end supports configured to support either the first end or the second end of the one or more elongated shelves, where each of the pair of end supports comprises:

a first vertical member and a second vertical member, at least one cross-support, said at least one cross-support having a first end rotatably coupled to said first vertical member and a second end having a sliding lock mechanism comprising a shuttle and at least one ear extending outwardly from the shuttle, the sliding lock mechanism being configured to move between an unlocked position and a locked position, wherein when the sliding lock mechanism moves from the unlocked position to the locked position, the at least one ear moves from a retracted position corresponding to the at least one ear being disposed internal to said at least one cross-support and an extended position corresponding to the at least one ear extending at least partially through the at least one cross-support, in order to lock the sliding lock mechanism to said second vertical member.

20. The rack system according to claim 19, wherein said second vertical member comprises a connection pin and when said sliding lock mechanism is moved to said locked position, said connection pin is captured in a slot in said shuttle of said sliding lock mechanism.

* * * * *